US011315535B2

(12) United States Patent
Zhang et al.

(10) Patent No.: US 11,315,535 B2
(45) Date of Patent: Apr. 26, 2022

(54) LIVE STREAM PROCESSING METHOD, APPARATUS, SYSTEM, ELECTRONIC APPARATUS AND STORAGE MEDIUM

(71) Applicant: BEIJING DAJIA INTERNET INFORMATION TECHNOLOGY CO., LTD., Beijing (CN)

(72) Inventors: Xiaobo Zhang, Beijing (CN); Xiaobo Zhang, Beijing (CN)

(73) Assignee: Beijing Dajia Internet Information Technology Co., Ltd., Beijing (CN)

( * ) Notice: Subject to any disclaimer, the term of this patent is extended or adjusted under 35 U.S.C. 154(b) by 121 days.

(21) Appl. No.: 16/838,580

(22) Filed: Apr. 2, 2020

(65) Prior Publication Data

US 2020/0234684 A1 Jul. 23, 2020

(30) Foreign Application Priority Data

Apr. 2, 2019 (CN) ..... 201910263495.X
May 16, 2019 (CN) ..... 201910407822.4

(51) Int. Cl.
*G10H 1/36* (2006.01)
*G10H 1/00* (2006.01)

(52) U.S. Cl.
CPC ..... *G10H 1/365* (2013.01); *G10H 1/0008* (2013.01); *G10H 2210/005* (2013.01); *G10H 2220/011* (2013.01); *G10H 2240/011* (2013.01)

(58) Field of Classification Search
CPC ..... G10H 1/365; G10H 1/0008; G10H 2210/005; G10H 2220/011; G10H 2240/011; G10H 1/361; G10H 2240/131; G10H 2240/175; H04N 21/4307; H04N 21/2187; H04N 21/439
(Continued)

(56) References Cited

U.S. PATENT DOCUMENTS 5,889,224 A * 3/1999 Tanaka ..... G10H 1/361 84/645
9,601,127 B2 * 3/2017 Yang ..... G10H 1/366
(Continued)

FOREIGN PATENT DOCUMENTS

CN 102456340 A 5/2012
CN 103337240 A 10/2013
(Continued)

*Primary Examiner* — Jeffrey Donels
(74) *Attorney, Agent, or Firm* — Meunier Carlin & Curfman LLC

(57) ABSTRACT

The present disclosure provides a live stream processing method, apparatus and system, electronic device and a storage medium. The first electronic device acquires target song information provided by second electronic device, and the target song information at least includes a target song identifier. Afterwards, the first electronic device plays the accompaniment audio synchronously with the second electronic device according to a target song identifier when the notification information is received, that is, when the second electronic device plays the accompaniment audio of the target song, and the first electronic device acquires the singing audio sent by the second electronic device through a server. Finally, the first electronic device takes the played accompaniment audio and the singing audio as a live stream and sends the live stream to the server.

18 Claims, 12 Drawing Sheets

(58) Field of Classification Search
USPC ..... 434/307 A
See application file for complete search history.

(56) References Cited

U.S. PATENT DOCUMENTS

| | | | | |
|---|---|---|---|---|
| 9,852,742 | B2 * | 12/2017 | Cook | G10H 1/366 |
| 9,866,731 | B2 * | 1/2018 | Godfrey | H04N 5/04 |
| 11,093,210 | B2 * | 8/2021 | Hersh | G06F 3/017 |
| 2003/0014262 | A1 * | 1/2003 | Kim | G06Q 30/02 704/278 |
| 2007/0065794 | A1 * | 3/2007 | Mangum | G10H 1/365 434/307 A |
| 2007/0287141 | A1 * | 12/2007 | Milner | G09B 5/00 434/307 A |
| 2008/0113325 | A1 * | 5/2008 | Mellqvist | G06Q 30/0601 434/307 A |
| 2011/0144981 | A1 * | 6/2011 | Salazar | G10H 1/368 704/207 |
| 2011/0276333 | A1 * | 11/2011 | Wang | G06F 16/95 704/270 |
| 2014/0358566 | A1 * | 12/2014 | Zhang | G10L 19/008 704/500 |
| 2015/0120308 | A1 * | 4/2015 | Leistikow | G10H 1/366 704/500 |
| 2016/0358595 | A1 * | 12/2016 | Sung | G11B 27/02 |
| 2018/0232446 | A1 * | 8/2018 | Zhu | G06F 16/634 |
| 2018/0288467 | A1 * | 10/2018 | Holmberg | H04N 21/4788 |
| 2018/0349495 | A1 * | 12/2018 | Zhao | G06F 16/685 |
| 2018/0374462 | A1 * | 12/2018 | Steinwedel | G10H 1/366 |

FOREIGN PATENT DOCUMENTS

| | | | |
|---|---|---|---|
| CN | 105808710 | A | 7/2016 |
| CN | 108922562 | A | 11/2018 |
| JP | 2004500662 | A | 1/2004 |

* cited by examiner

LIVE STREAM PROCESSING METHOD, APPARATUS, SYSTEM, ELECTRONIC APPARATUS AND STORAGE MEDIUM

CROSS-REFERENCE TO RELATED APPLICATIONS

The present disclosure claims the benefit of Chinese Patent Application No. 201910263495.X, filed with the China National Intellectual Property Administration on Apr. 2, 2019 and entitled "Live Stream Processing Method and System, and Computer Readable Storage Medium", and Chinese Patent Application No. 201910407822.4, filed with the China National Intellectual Property Administration on May 16, 2019 and entitled "Live Stream Processing Method, Apparatus, System, Electronic Apparatus, and Computer Readable Storage Medium", both of which are hereby incorporated by reference in their entireties.

FIELD

The present disclosure belongs to the technical field of computers, in particular to a live stream processing method, apparatus and system, electronic device and a storage medium.

BACKGROUND

At present, along with an increasing need for spiritual culture among users, people often sing songs with multiple friends, however, due to limitations of site and time, for example, there is no sufficient time to go to a special karaoke TV (KTV) or there is difficult to find opportunities to get together with friends to sing. As such, there is a need to find a way to allow people to sing together.

In related technologies, a streamer usually establishes a studio through host equipment, while other users join in the studio as non-host users. When a certain non-host user wants to sing, he can play an accompaniment audio through his own equipment, and then sing according to the accompaniment audio. Meanwhile, the equipment of the non-host user will collect the singing audio and send the singing audio to the host equipment with a stream pushing permission through a server. The host equipment will collect the singing audio and the accompaniment audio played by the host equipment as a live stream, and send the live stream to the equipment of other non-host users through the server. In this way, other non-host users can play the live stream through their own equipments to listen to the sung song. However, in related technologies, in the sung song played by the equipment of other non-host users, the singing audio is often not synchronized with the accompaniment audio, thereby leading to a poor singing effect.

SUMMARY

The present disclosure provides a live stream processing method, apparatus and system, electronic device and a storage medium, to solve the problem that a singing voice is not synchronized with an accompaniment audio, which further leads to a poor singing effect.

According to a first aspect of the present disclosure, a live stream processing method applied to a first electronic device is provided, the method including:

acquiring target song information provided by a second electronic device, where the target song information at least includes a target song identifier;

playing an accompaniment audio of the target song synchronously with the second electronic device according to the target song identifier when receiving notification information, and acquiring a singing audio sent by the second electronic device, where the notification information is used for indicating that the second electronic device begins to play the accompaniment audio; and taking the played accompaniment audio and the singing audio as a live stream, and sending the live stream to a server.

In one possible implementation, the method further includes:

receiving accompaniment audio calibration information provided by the second electronic device, where the accompaniment audio calibration information is provided by the second electronic device in a process of playing the accompaniment audio; and calibrating the played accompaniment audio according to the accompaniment audio calibration information.

In one possible implementation, the accompaniment audio calibration information includes lyrics sung by the user at the sending moment and playing moment of the corresponding accompaniment audio;

here calibrating the played accompaniment audio according to the accompaniment audio calibration information includes:

adjusting the playing schedule at which the accompaniment audio is played to the playing moment of the accompaniment audio if a singing audio matched with the lyrics included in the accompaniment audio calibration information is collected.

In one possible implementation, the target song information further includes singing range information;

where playing an accompaniment audio of the target song synchronously with the second electronic device according to the target song identifier when receiving notification information includes:

acquiring the accompaniment audio of the target song according to the target song identifier; and establishing an audio playing unit, and playing a segment indicated by the singing range information in the accompaniment audio by utilizing the audio playing unit when receiving the notification information.

In one possible implementation, before sending the live stream to a server, the method further includes: inserting lyric timestamps into the live stream according to the playing moment corresponding to each data segment in the live stream.

According to a second aspect of the present disclosure, a live stream processing method applied to a second electronic device is provided, the method including:

providing target song information to a first electronic device, wherein the target song information at least includes a target song identifier;

playing the accompaniment audio of the target song according to the target song identifier, and sending notification information when beginning to play the accompaniment audio; wherein the notification information is used for indicating that the second electronic device begins to play the accompaniment audio; and collecting the singing audio, and sending the singing audio.

In one possible implementation, the target song information further includes singing range information;

before providing target song information to first electronic device, the method further includes:

displaying a singing range selection page if receiving a singing range setting instruction; and detecting a selection operation on the singing range selection page, and acquiring a start timestamp and an end timestamp according to the selection operation to obtain the singing range information.

where providing target song information to first electronic device includes:

providing the singing range information and the target song identifier to the first electronic device.

In one possible implementation, playing the accompaniment audio of the target song according to the target song identifier includes:

acquiring an accompaniment audio corresponding to the target song identifier and a lyric file, and establishing an accompaniment playing unit; and playing a segment indicated by the singing range information in the accompaniment audio by utilizing the accompaniment playing unit, and displaying the segment indicated by the singing range information in the lyric file.

According to a third aspect of the present disclosure, a live stream processing method applied to a third electronic device is provided, the method including:

acquiring target song information provided by a second electronic device, wherein the target song information at least includes the target song identifier;

acquiring a lyric file of the target song according to the target song information;

receiving a live stream sent by a server, where the live stream includes a lyric timestamp; and analyzing the live stream, and displaying corresponding lyrics in the lyric file of the target song according to the lyric timestamp in the live stream.

In one possible implementation, the target song information further includes singing range information, and the step of acquiring a lyric file of the target song according to the target song information includes:

determining a lyric file matched with the target song identifier; and acquiring a segment indicated by the singing range information in the matched lyric file, to obtain a lyric file of the target song.

According to a fourth aspect of the present disclosure, a live stream processing apparatus applied to a first electronic device is provided, the apparatus including:

a first acquisition module, configured to acquire target song information provided by the second electronic device, wherein the target song information at least includes a target song identifier;

a synchronous playing module, configured to play an accompaniment audio of the target song synchronously with the second electronic device according to the target song identifier when receiving notification information, and acquire a singing audio sent by the second electronic device, wherein the notification information is used for indicating that the second electronic device begins to play the accompaniment audio; and a first sending module, configured to take the played accompaniment audio and the singing audio as a live stream, and send the live stream to a server.

In one possible implementation, the apparatus further includes:

a first receiving module, configured to receive accompaniment audio calibration information provided by the second electronic device, wherein the accompaniment audio calibration information is provided by the second electronic device in a process of playing the accompaniment audio; and a calibration module, configured to calibrate the played accompaniment audio according to the accompaniment audio calibration information.

In one possible implementation, the accompaniment audio calibration information includes lyrics sung by the user at the sending moment and playing moment of the corresponding accompaniment audio;

the calibration module is configured to:

adjust the playing schedule at which the accompaniment audio is played to the playing moment of the accompaniment audio if a singing audio matched with the lyrics included in the accompaniment audio calibration information is collected.

In one possible implementation, the target song information further includes singing range information;

the synchronous playing module is configured to:

acquire the accompaniment audio of the target song according to the target song identifier; and establish an audio playing unit, and play a segment indicated by the singing range information in the accompaniment audio by utilizing the audio playing unit when the notification information is received.

In one possible implementation, the apparatus further includes: an inserting module, configured to insert lyric timestamps into the live stream according to the playing moment corresponding to each data segment in the live stream.

According to a fifth aspect of the present disclosure, a live stream processing apparatus applied to a second electronic device is provided, the apparatus including:

a second sending module, configured to provide target song information to a first electronic device, where the target song information at least includes a target song identifier;

a playing module, configured to play the accompaniment audio of the target song according to the target song identifier, and send notification information at the beginning of the playing of the accompaniment audio; wherein the notification information is used for indicating that the second electronic device begins to play the accompaniment audio; and a third sending module, configured to collect the singing audio, and send the singing audio.

In one possible implementation, the target song information further includes singing range information;

the apparatus further includes:

a first display module, configured to display a singing range selection page if a singing range setting instruction is received; and a second acquisition module, configured to detect a selection operation on the singing range selection page, and acquire a start timestamp and an end timestamp according to the selection operation to obtain the singing range information.

where the second sending module is configured to:

provide the singing range information and the target song identifier to the first electronic device.

In one possible implementation, the playing module is configured to:

acquire an accompaniment audio corresponding to the target song identifier and a lyric file, and establish an accompaniment playing unit; and play a segment indicated by the singing range information in the accompaniment audio by utilizing the accompaniment playing unit, and display the segment indicated by the singing range information in the lyric file.

According to a sixth aspect of the present disclosure, a live stream processing apparatus applied to third electronic device is provided, the apparatus including:

a third acquisition module, configured to acquire target song information provided by second electronic device, wherein the target song information at least includes the target song identifier;

a fourth acquisition module, configured to acquire a lyric file of the target song according to the target song information;

a second receiving module, configured to receive the live stream sent by a server, wherein the live stream includes a lyric timestamp; and a second display module, configured to analyze the live stream, and display corresponding lyrics in the lyric file of the target song according to the lyric timestamp in the live stream.

In one possible implementation, the target song information further includes singing range information, and the fourth acquisition module is configured to:

determine the lyric file matched with the target song identifier; and acquire a segment indicated by the singing range information in the matched lyric file, to obtain a lyric file of the target song.

According to a seventh aspect of the present disclosure, a live stream processing system is provided, and the live stream processing system includes a first electronic device, a second electronic device, a third electronic device and a server;

the second electronic device is configured to provide target song information to the first electronic device, wherein the target song information at least includes a target song identifier;

the first electronic device is configured to acquire the target song information provided by the second electronic device;

the second electronic device is configured to play the accompaniment audio of the target song according to the target song identifier, and send notification information at the beginning of the playing of the accompaniment audio;

the second electronic device is configured to collect the singing audio, and send the singing audio;

the first electronic device is configured to play an accompaniment audio of the target song synchronously with the second electronic device according to the target song identifier when notification information is received, and acquire a singing audio sent by the second electronic device;

the first electronic device is configured to take the played accompaniment audio and the singing audio as a live stream, and send the live stream to the server;

the third electronic device is configured to acquire target song information provided by the second electronic device, and acquire a lyric file of the target song according to the target song information, wherein the target song information at least includes the target song identifier;

the third electronic device is configured to receive the live stream sent by a server, wherein the live stream includes a lyric timestamp; and the third electronic device is configured to analyze the live stream, and display corresponding lyrics in the lyric file of the target song according to the lyric timestamp in the live stream.

According to an eighth aspect of the present disclosure, electronic device is provided, wherein the electronic device includes: a processer; and a memory configured to store executable instructions of the processor; wherein the processor is configured to execute the instructions, to implement the operations performed by the live stream processing method of any item of the first aspect, or any item of the second aspect, or any item of the third aspect.

According to a ninth aspect of the present disclosure, a storage medium is provided, where when the instructions in the storage medium are executed by the processor of the electronic device, the electronic device can implement the operations performed by the live stream processing method of any item of the first aspect, or any item of the second aspect, or any item of the third aspect.

According to a tenth aspect of the present disclosure, an application is provided, where when the application is executed by a processor, the application can implement the operations performed by the live stream processing method of any item of the first aspect, or any item of the second aspect, or any item of the third aspect.

The above description is merely a summary of the technical solution of the present disclosure. In order to more clearly understand the technical means of the present disclosure, such that the present disclosure can be implemented according to the contents of the description, and in order that the above and other objectives, features and advantages of the present disclosure are more apparent and understandable, some specific embodiments of the present disclosure are hereby enumerated below.

BRIEF DESCRIPTION OF THE DRAWINGS

Through reading detailed description of the preferred embodiments below, various other advantages and beneficial effects will become clear and apparent to those skilled in the art. The accompanying drawings are merely used for illustrating the objective of the preferred embodiments, rather than for limiting the present disclosure. Moreover, in the whole drawings, the same reference numeral represents the same part. In the drawings.

DETAILED DESCRIPTION OF THE EMBODIMENTS

Figure 1:
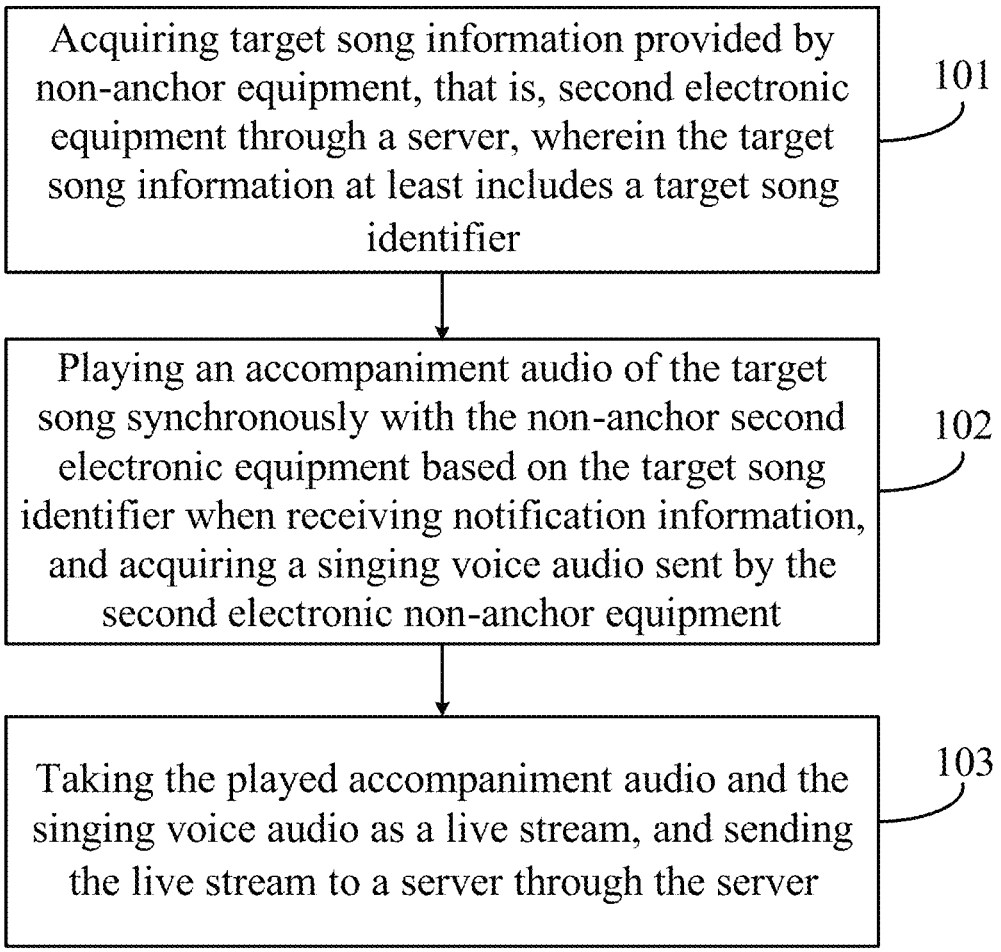
FIG. 1 is a flow chart of a live stream processing method provided in an embodiment of the present disclosure.

Exemplary embodiments of the present disclosure will be described in detail below with reference to accompanying drawings. Although exemplary embodiments of the present disclosure are displayed in the drawings, it should be understood that, the present disclosure can be implemented in various forms, rather than being limited by the embodiments described herein. In contrary, these embodiments are provided to more thoroughly understand the present disclosure, and completely convey the scope of the present disclosure to those skilled in the art.

FIG. 1 is a flow chart of a live stream processing method provided in an embodiment of the present disclosure, the live stream processing method is applicable to a first electronic device, as shown in FIG. 1, the method can include the following steps.

Step 101, acquiring target song information provided by second electronic device, where the target song information at least includes a target song identifier.

In an embodiment of the present disclosure, the first electronic device and all the second electronic device are all in the same studio. The studio can be a virtual room established according to live streaming software, the permission of the first electronic device corresponds to the permission of the host function, and the permission of the second electronic device corresponds to the permission of the non-host function. The studio can be opened by a user through first electronic device, and the studio can be a studio which is in a KTV mode and at which songs can be sung. The first electronic device and the second electronic device can be mobile phones, tablet personal computers, computers and other electronic device which can involve in live streaming. The second equipment can be any second electronic device which is in the same studio as the first electronic device. Further, the target song identifier can be a name of a song, the target song represents that the target song can be determined by the second electronic device according to the songs that the user chooses to sing. Further, the target song information can be provided by second electronic device through a server, where the second electronic device and the first electronic device can be connected with the server through keep-alive (long connection) in advance, such that data can be sent through the server. Specifically, in the present step, the second electronic device can send a target song identifier to the server according to the keep-alive with the server, then the server can take the target song identifier as target song information and send to the first electronic device through keep-alive with the first electronic device, correspondingly, the first electronic device can acquire the target song information by receiving the target song information. In the embodiment of the present disclosure, through the manner of sending data via the keep-alive established in advance, no connection needs to be established in advance before each sending, thereby improving efficiency of sending the target song information.

Step 102, playing an accompaniment audio of the target song synchronously with the second electronic device according to the target song identifier when receiving notification information, and acquiring a singing audio sent by the second electronic device.

In the embodiment of the present disclosure, the notification information is used for indicating that the second electronic device begins to play the accompaniment audio. The singing audio can be collected in the process in which the second electronic device plays the accompaniment audio, the singing audio and notification information can be sent by the second electronic device to the first electronic device through the server according to long connection between the second electronic device and the server. Further, since the user of the second electronic device often sings along to the accompaniment audio, therefore, in the embodiment of the present disclosure, the first electronic device plays synchronously the accompaniment audio when the notification information is received, that is, when the second electronic device begins to play the accompaniment audio, in this way, the accompaniment audio played by the first electronic device and the acquired singing audio in the live stream collected in the subsequent steps can be synchronized to a certain extent, thereby improving the singing effect. Specifically, the second electronic device can send notification information through a server at the beginning of the playing of the accompaniment audio, correspondingly, the first electronic device can also begin to play the accompaniment audio according to a target song identifier when knowing that the second electronic device begins to play the accompaniment audio, thereby realizing synchronous playing. Meanwhile, since the time spent in sending the notification information is less and can be omitted, therefore, according to notification information, the first electronic device can play the accompaniment audio synchronously with the second electronic device according to target song information when the second electronic device plays the accompaniment audio.

Step 103, taking the played accompaniment audio and the singing audio as a live stream, and sending the live stream to a server.

In an embodiment of the present disclosure, the first electronic device sends the live stream to the server, and sends the live stream to third electronic device through the server, where, the third electronic device can be other electronic device which listens to the singing in the studio. Further, the manner of collecting the live stream can refer to related technologies, and will not be repeated redundantly in the embodiment of the present disclosure. It should be noted that, in practical applications, when the user of the second electronic device sings through the second electronic device, the playing volume of the accompaniment audio of the second electronic device will often be adjusted to a volume suitable for singing. However, the volume suitable for singing is often different from the volume suitable to be listened to by other users, therefore, in the embodiment of the present disclosure, through the manner in which the first electronic device collects the accompaniment audio played by the first electronic device and the acquired singing audio as a live stream, the user of the first electronic device can adjust the playing volume of the accompaniment audio played by the first electronic device according to the volume suitable to be listened to through the first electronic device, such that when the collected live stream is subsequently played by the third electronic device, the live stream can have a good listening effect.

In summary, as to the live stream processing method provided in the embodiment of the present disclosure, the first electronic device will acquire target song information provided by the second electronic device, where the target song information at least includes a target song identifier. Afterwards, the first electronic device will play the accompaniment audio synchronously with the second electronic device according to a target song identifier when the notification information is received, that is, when the second electronic device plays the accompaniment audio of the target song, and the first electronic device acquires the singing audio sent by the second electronic device. Finally, the first electronic device takes the played accompaniment audio and the singing audio as a live stream and sends the live stream to the server. Since the user of the second electronic device often sings corresponding to the accompaniment audio, in the embodiment of the present disclosure, the first electronic device plays synchronously the accompaniment audio when the second electronic device begins to play the accompaniment audio, in this way, the accompaniment audio and the singing voice in the live stream obtained according to collected accompaniment audio played by the first electronic device and acquired singing audio in the subsequent steps can be synchronized to a certain extent, thereby improving the singing effect.

Figure 2:
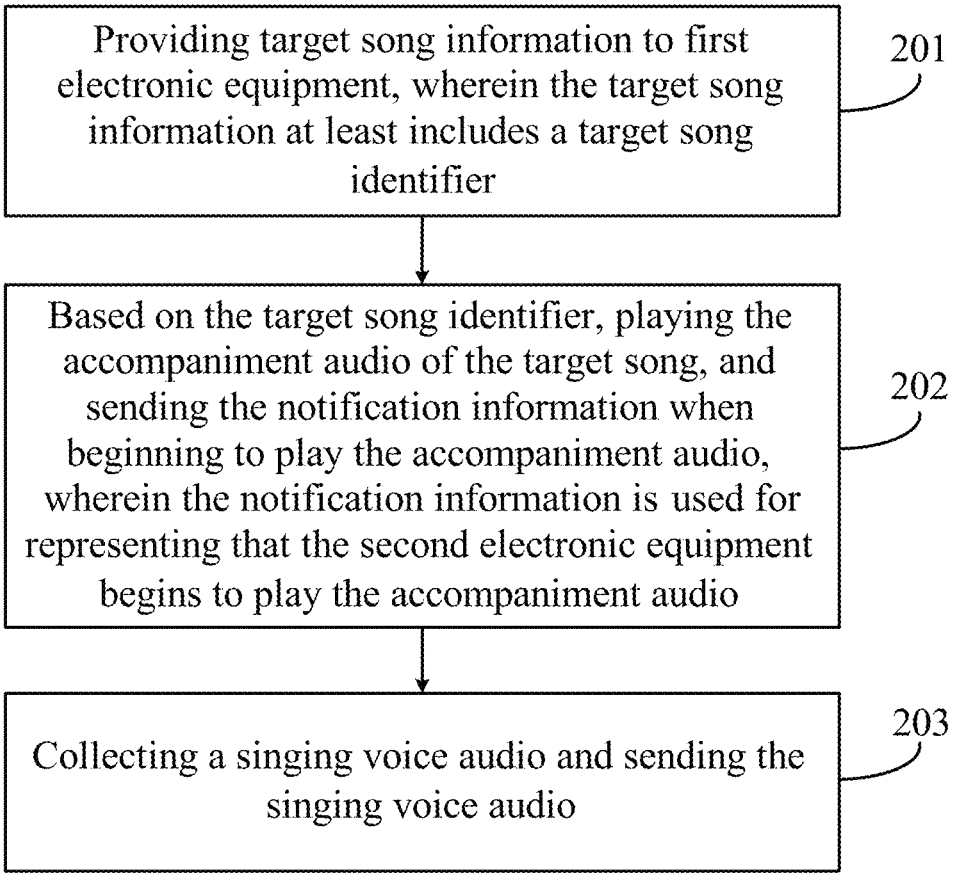
FIG. 2 is a flow chart of another live stream processing method provided in an embodiment of the present disclosure.

FIG. 2 is a flow chart of another live stream processing method provided in an embodiment of the present disclosure, the live stream processing method is applicable to second electronic device, as shown in FIG. 2, the method can include the following steps.

Step 201, providing target song information to first electronic device, where the target song information at least includes a target song identifier.

In the embodiment of the present disclosure, second electronic device can send target song information to the first electronic device through a server when receiving a song request instruction sent by the user of the second electronic device, where the song request instruction can include a target song identifier, and the target song identifier can be an identifier corresponding to the song selected by the user of the second electronic device. Further, the second electronic device can send the target song identifier to the server according to the long connection between the second electronic device and the server, then the server can take the target song identifier as target song information, and send to the first electronic device through the long connection between the server and the first electronic device, and further provide target song information to the first electronic device.

Step 202, according to the target song identifier, playing the accompaniment audio of the target song, and sending the notification information when beginning to play the accompaniment audio, where the notification information is used for indicating that the second electronic device begins to play the accompaniment audio.

In an embodiment of the present disclosure, the second electronic device can acquire an accompaniment audio corresponding to a target song identifier from the server, where the accompaniment audio corresponding to the target song identifier refers to the accompaniment audio of the target song represented by the target song identifier. Of course, the second electronic device can also search corresponding accompaniment audio from network according to the target song identifier, which is not defined in the embodiment of the present disclosure. Further, the second electronic device can send the notification information to the first electronic device through a sever, since the user of the second electronic device often sings along to the accompaniment audio, therefore, in the embodiment of the present disclosure, the second electronic device sends notification information to the first electronic device at the beginning of the playing of the accompaniment audio, such that the first electronic device can play the accompaniment audio synchronously with the second electronic device, therefore, the accompaniment audio and the singing audio in the live stream pushed by the first electronic device to the third electronic device can be synchronized to a certain extent, thereby improving the singing effect.

Step 203, collecting a singing audio and sending the singing audio.

In an embodiment of the present disclosure, the second electronic device can collect the singing audio of the user of the second electronic device through a configured voice collection apparatus in the process of playing the accompaniment audio, further, the second electronic device can send a singing audio to the server according to a long connection between the second electronic device and a server, and then send the singing audio to the first electronic device through the server.

In summary, as to the live stream processing method provided in an embodiment of the present disclosure, the second electronic device provides target song information to the first electronic device, where the second electronic device plays the accompaniment audio of the target song according to a target song identifier and sends notification information representing that the second electronic device begins to play the accompaniment audio at the beginning of the playing of the accompaniment audio, such that the first electronic device will play the accompaniment audio synchronously with the second electronic device, finally collect and send the singing audio. Since the user of the second electronic device often sings corresponding to the accompaniment audio, therefore, in the embodiment of the present disclosure, the accompaniment audio and the singing audio in the live stream pushed by the first electronic device to the third electronic device in the subsequent processes can be synchronized to a certain extent, thereby improving the singing effect.

Figure 3:
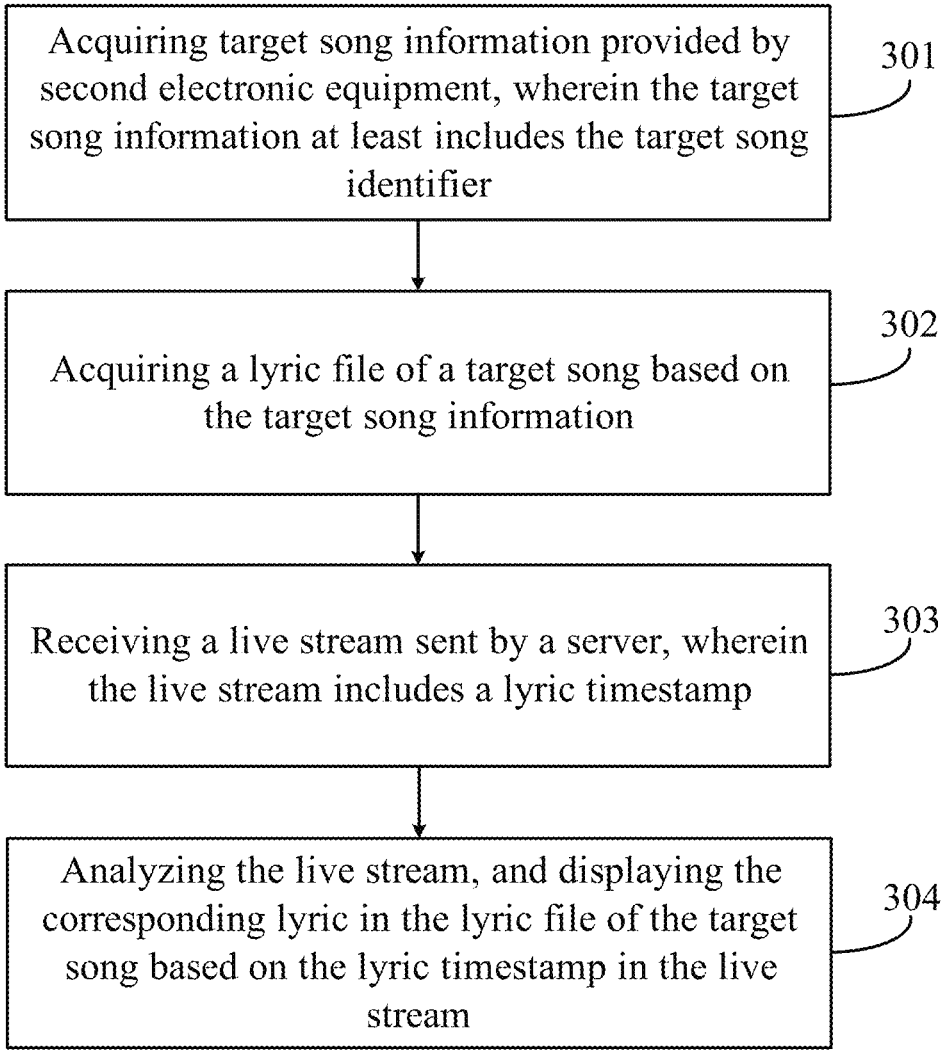
FIG. 3 is a flow chart of still another live stream processing method provided in an embodiment of the present disclosure.
Figure 4A:
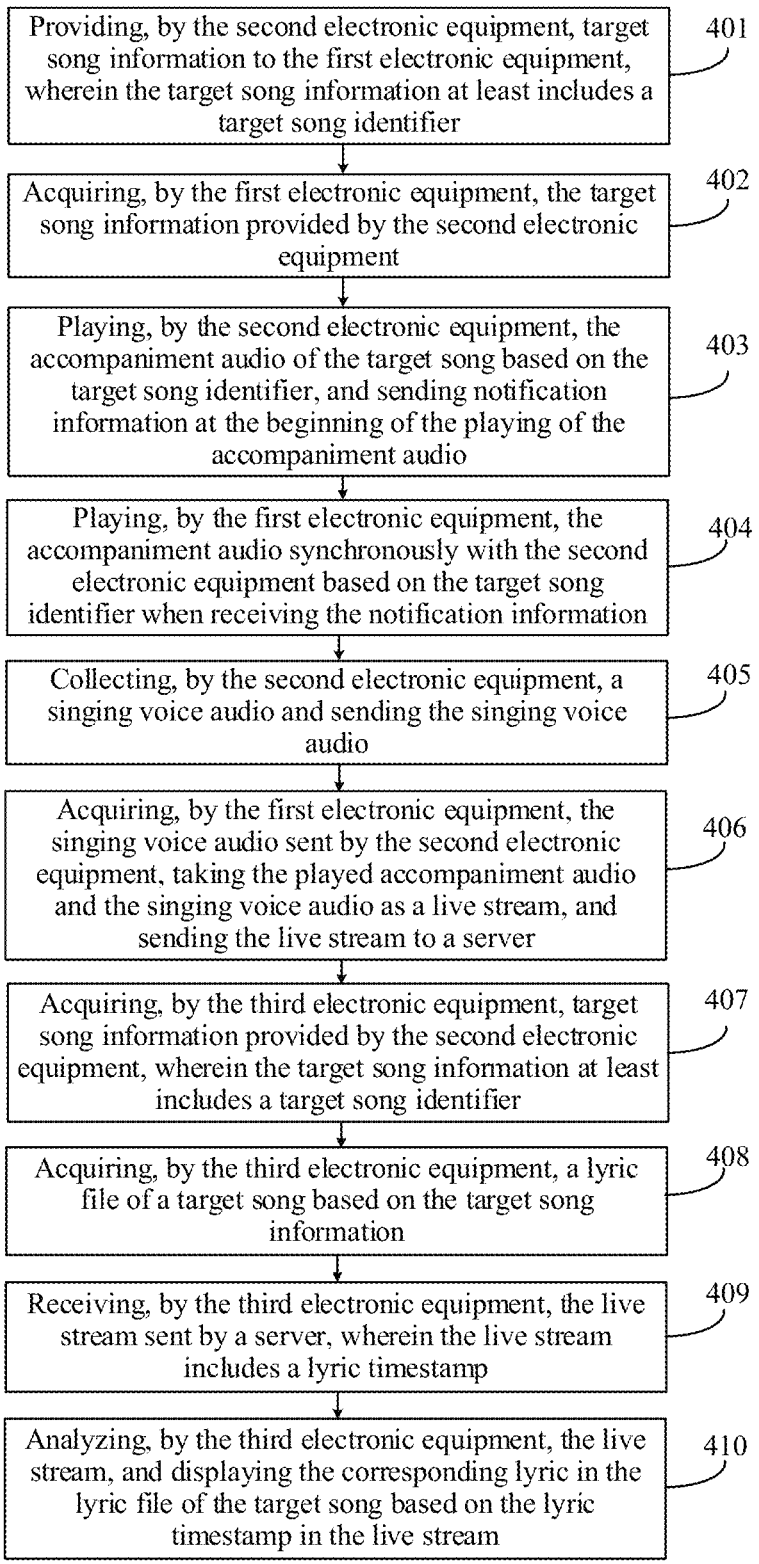
FIG. 4A is a flow chart for still another live stream processing method provided in an embodiment of the present disclosure.
Figure 4B:
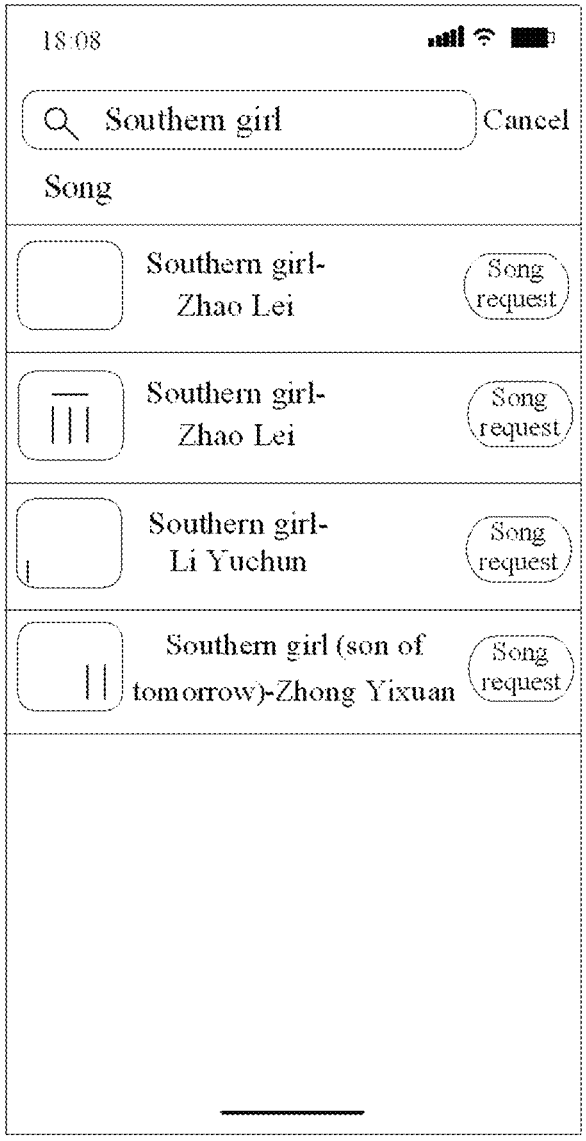
FIG. 4B is a search interface diagram provided in an embodiment of the present disclosure.
Figure 4C:
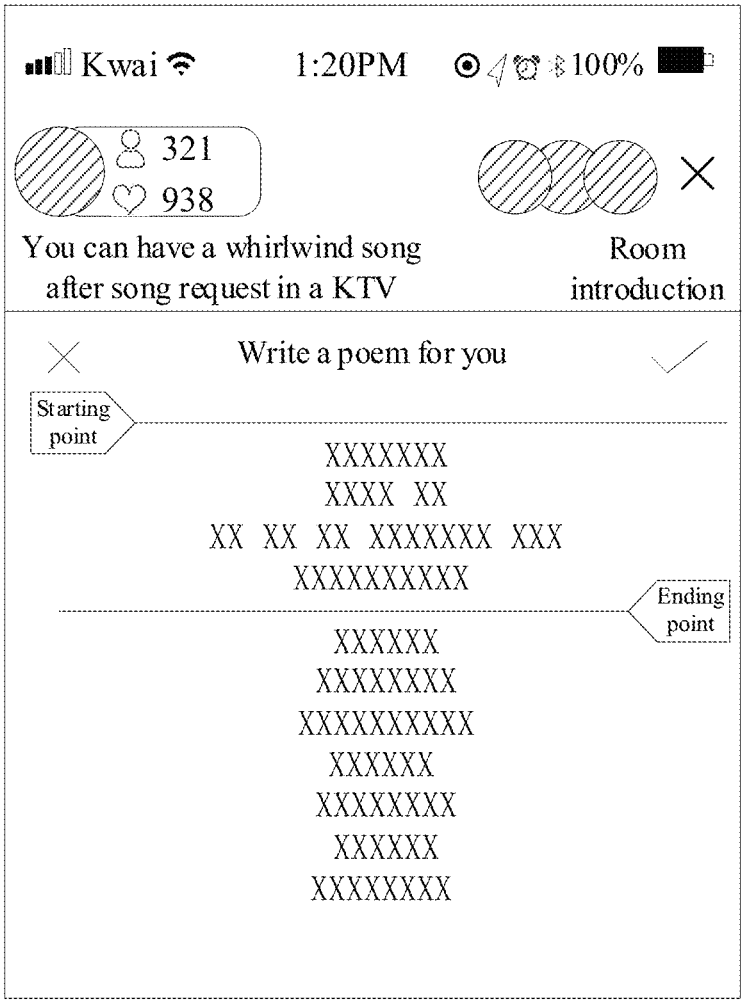
FIG. 4C is a schematic diagram of a singing range selection page after selection provided in an embodiment of the present disclosure.
Figure 4D:
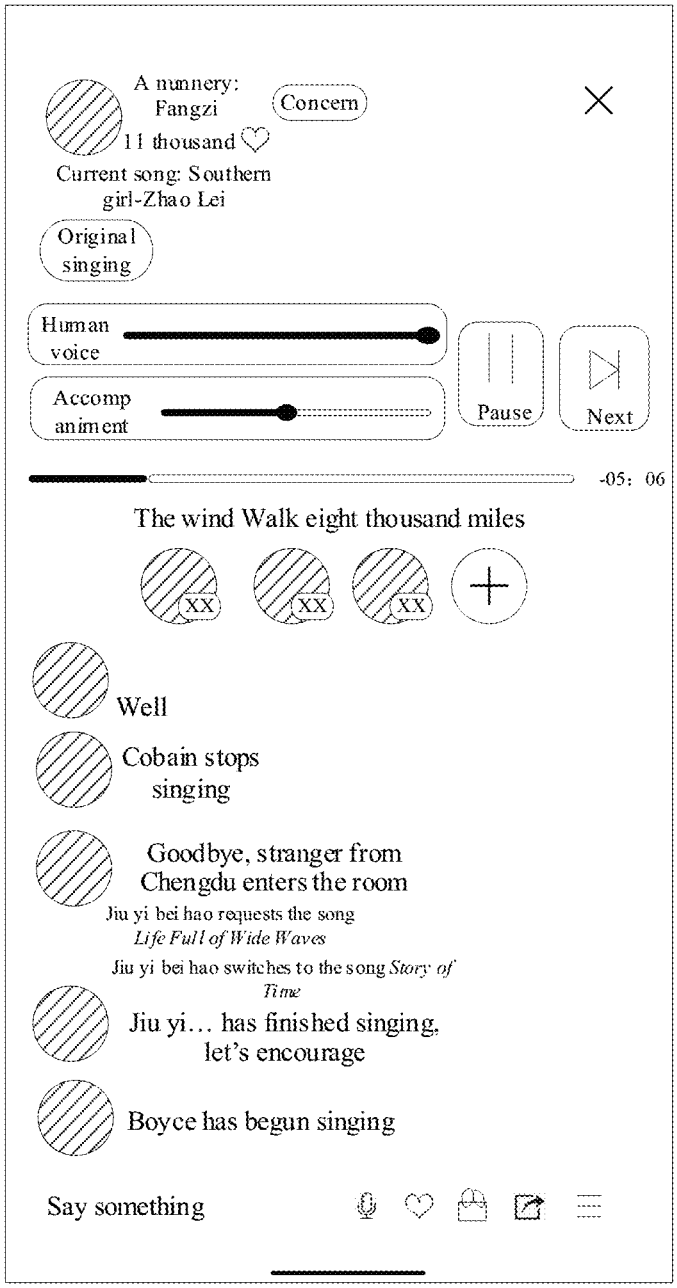
FIG. 4D is a schematic diagram of a volume adjustment interface.
Figure 4E:
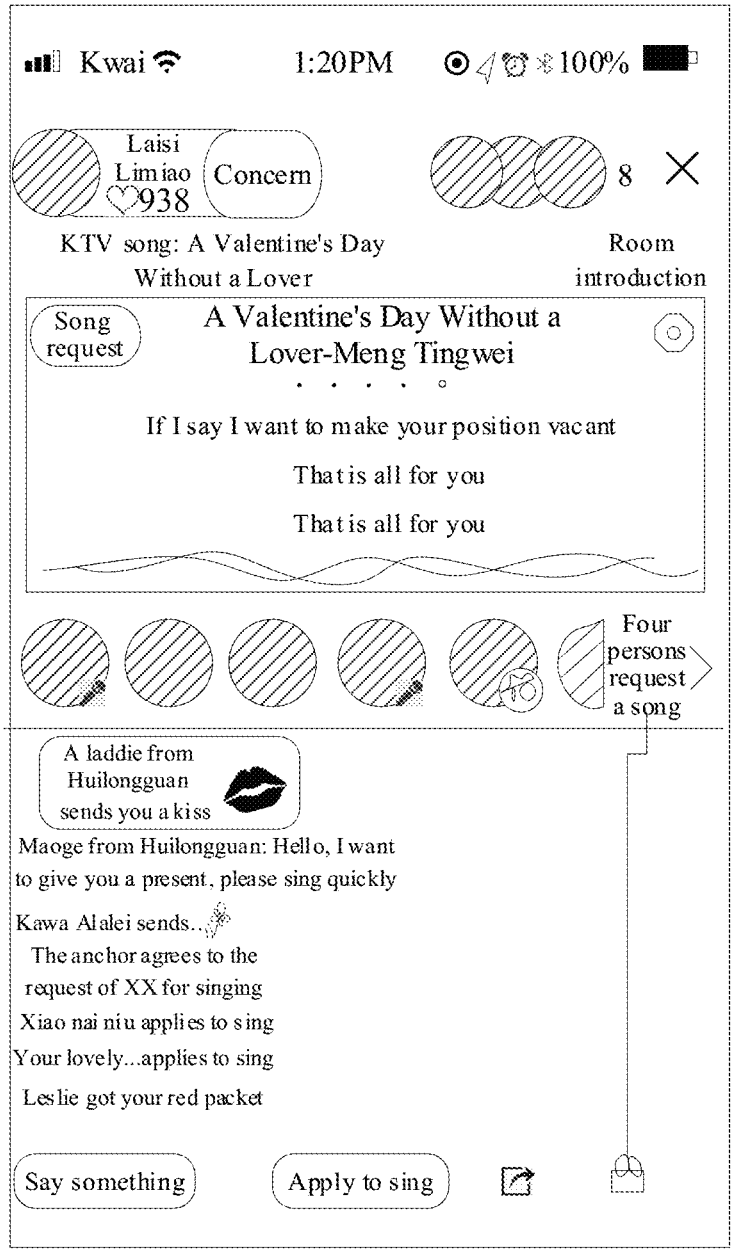
FIG. 4E is a schematic diagram of an interface of third electronic device.
Figure 4F:
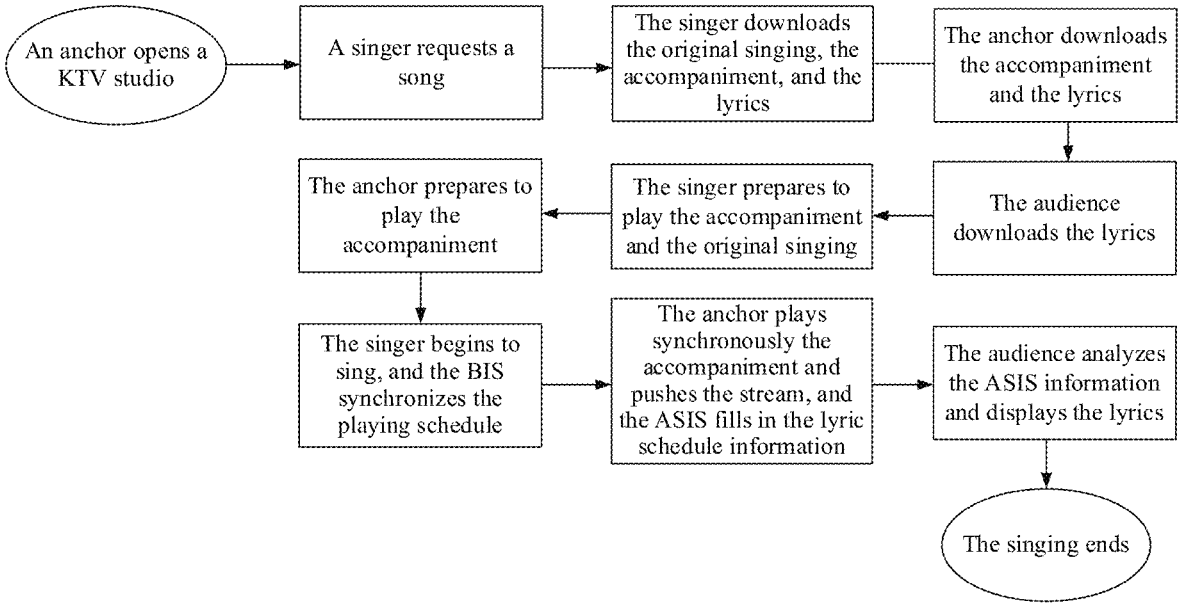
FIG. 4F is a schematic diagram of a singing process.

FIG. 3 is a flow chart of another live stream processing method provided in the embodiment of the present disclosure, the live stream processing method is applicable to third electronic device, as shown in FIG. 3, the method can include the following steps.

Step 301, acquiring target song information provided by second electronic device, where the target song information at least includes the target song identifier.

In the embodiment of the present disclosure, the target song identifier can be provided by second electronic device through a server. Specifically, the third electronic device can be connected with the server through long connection in advance, correspondingly, the second electronic device can send a target song identifier to the server according to the long connection with the server, then the server can take the target song identifier as the target song information, and send to the third electronic device through the long connection with the third electronic device. Correspondingly, the third electronic device can acquire the target song information by receiving the target song information.

Step 302, acquiring a lyric file of a target song according to the target song information.

In the embodiment of the present disclosure, the third electronic device can acquire a lyric file matched with the target song identifier in the target song information, to further obtain the lyric file of the target song.

Step 303, receiving a live stream sent by a server, where the live stream includes a lyric timestamps.

In the embodiment of the present disclosure, the lyric timestamps can be inserted into the live stream before the first electronic device sends the live stream, and the lyric timestamps can indicate the playing moment corresponding to the audio data segment at the inserting position. Further, the server can send the live stream to the third electronic device after receiving the live stream sent by the first electronic device, correspondingly, the third electronic device can receive the live stream sent by the server.

Step 304, analyzing the live stream, and displaying the corresponding lyric in the lyric file of the target song according to the lyric timestamps in the live stream.

In the embodiment of the present disclosure, the third electronic device can establish a playing unit, and the playing unit can be a player which can play audios. Afterwards, the received live stream is analyzed by utilizing the playing unit, specifically, the implementation manner of the analyzing operation can refer to related technologies, meanwhile, if the lyric timestamps in the live stream are analyzed, the third electronic device can display the lyric corresponding to the lyric timestamps in the lyric file, thereby realizing synchronous display of lyrics.

In summary, in the live stream processing method provided in an embodiment of the present disclosure, the third electronic device will acquire target song information provided by the second electronic device, where the target song information can at least include a target song identifier. The third electronic device acquires a lyric file of the target song according to the target song information, and then receives the live stream sent by a server. The live stream includes lyric timestamps, the live stream is analyzed, and the corresponding lyric in the lyric file of the target song is displayed according to the lyric timestamps in the live stream. Since the live stream is collected by the first electronic device when the first electronic device plays the accompaniment audio synchronously with the second electronic device, therefore, the accompaniment audio and the singing audio in the live stream are synchronous, correspondingly, the third electronic device can play audios with a higher synchronization degree through analyzing the live stream. Meanwhile, the corresponding lyric in the lyric file of the target song is displayed according to the lyric timestamps in the live stream, thereby displaying lyrics synchronously while playing, and further improving listening effect.

FIG. 4-1 is a flow chart of still another live stream processing method provided by an embodiment of the present disclosure, as shown in FIG. 4-1, the method can include the following steps.

Step 401, providing, by the second electronic device, target song information to the first electronic device, where the target song information at least includes a target song identifier.

In the present step, the second electronic device can send target song information to the first electronic device through a server when receiving the song request instruction containing the target song identifier. Specifically, the song request instruction can be sent by the user through triggering the song request function of the second electronic device, and the target song identifier can be a song identifier included in the song request instruction. Exemplarily, the second electronic device can display a song request button, the user of the second electronic device can click the song request button, the second electronic device can display a list of selectable songs after detecting that the user of the second electronic device clicks the song request button, the user can trigger the song request function of the second electronic device through a click operation on a certain selectable song in the list, correspondingly, the identifier of the selectable song clicked by the user is just the target song identifier.

Of course, the user can also search a song that the user wants to sing through a search button provided by the second electronic device, and then trigger the song request function of the second electronic device through selecting the searched song, which is not defined in the embodiment of the present disclosure. Exemplarily, FIG. 4-2 is a search interface diagram provided in an embodiment of the present disclosure. It can be seen from FIG. 4-2 that, the user searches four songs through the second electronic device. Further, the second electronic device can take the target song identifier as singing registration information and firstly send to the server, then the server sends the target song identifier to the first electronic device. It should be noted that, multiple users may request songs through their own second electronic devices, correspondingly, the server can process according to a sequential order in which each second electronic device sends singing registration information, thereby realizing song request by multiple users. In this way, even if a large number of users request songs, the stability of the server will not be influenced, thereby supporting the demand of song request by a large number of users in the studio.

Further, in actual application scenarios, the user may only want to sing part of the segments in the song, that is, after the user chooses a song he wants to sing through a song request instruction, he may also want to choose the segment he wants to sing in the song, therefore, in the embodiment of the present disclosure, the target song information can also include singing range information, correspondingly, before the second electronic device provides target song information to the first electronic device, the singing range information can be acquired through performing the following step A to step B, so as to satisfy the requirement of users of only singing part of the segments.

Step A, displaying, by the second electronic device, the singing range selection page if the singing range setting instruction is received.

In the present step, the singing range setting instruction can be sent to the second electronic device when the user needs to sing part of the segments of the target song. Specifically, the singing range setting instruction can be sent by the user through triggering the singing range setting function of the second electronic device. Exemplarily, the second electronic device can display one singing range setting button, and the user can click the singing range setting button to trigger the singing range setting function of the second electronic device. Correspondingly, the second electronic device can display the singing range selection page after detecting that the user clicks the singing range setting button. Further, the singing range selection page can be a page for the user to select a singing range, and the singing range selection page can be set according to actual requirements, which is not defined in the embodiment of the present disclosure.

Step B, detecting, by the second electronic device, the selection operation on the singing range selection page, and acquiring a start timestamp and an end timestamp according to the selection operation, to obtain the singing range information.

In the present step, the user can select the starting point and ending point of singing in the singing range selection page. Exemplarily, the user can cut the song singing segment in the singing range selection page, and the second electronic device can take the starting point of cutting as a starting point of singing, and take the ending point of cutting as the ending point of singing. FIG. 4-3 is a schematic diagram of a singing range selection page after selection provided in an embodiment of the present disclosure. It can be seen from FIG. 4-3 that, the user selects the starting point and the ending point in the singing range selection page.

Further, the second electronic device can determine the start timestamp and the end timestamp according to the selection operation of the user on the singing range selection page. Specifically, the second electronic device can take the timestamp corresponding to the starting point of singing selected by the user as the start timestamp, and take the timestamp corresponding to the ending point of singing selected by the user as an end timestamp. Where, the start timestamp indicates at which moment the playing of the song begins, and the end timestamp indicates at which moment the playing of the song ends. Exemplarily, the start timestamp can indicate the 1000th millisecond, while the end timestamp can indicate the 5000th millisecond.

Correspondingly, when the second electronic device provides target song information to the first electronic device, the second electronic device can provide the singing range information and the target song identifier to the first electronic device. Specifically, the singing range information and the target song identifier can be sent to the server, such that the server can take the singing range information and the target song identifier as the target song information, and send to the first electronic device. Exemplarily, suppose that the target song identifier is "AAA", and the singing range information is "1000th millisecond to 5000th millisecond", then the second electronic device can send "AAA" and "1000th millisecond to 5000th millisecond" to the server, correspondingly, the server can take "AAA" and "1000th millisecond to 5000th millisecond" as target song information and send to the first electronic device.

In the embodiment of the present disclosure, the singing range information is sent to the first electronic device, such that in the subsequent process, when the user only sings part of the segments, the first electronic device can play the accompaniment audio at the same moment as the second electronic device, and can end the playing of the accompaniment audio at the same moment as the second electronic device, thereby avoiding the problem of desynchrony of the second electronic device and the first electronic device since the user selects to sing part of the segments to a certain extent.

Step 402, acquiring, by the first electronic device, the target song information provided by the second electronic device.

Specifically, the present step can refer to the above step 101, which will not be repeated redundantly in the embodiment of the present disclosure.

Step 403, playing, by the second electronic device, the accompaniment audio of the target song according to the target song identifier, and sending notification information at the beginning of the playing of the accompaniment audio.

Specifically, the second electronic device can play an accompaniment audio of the target song through the following substep (1) to substep (2).

Substep (1): acquiring, by the second electronic device, the accompaniment audio corresponding to the target song identifier and the lyric file, and establishing an accompaniment playing unit.

In the present step, the accompaniment audio corresponding to the target song identifier and the lyric file refer to the accompaniment audio of the target song represented by the target song identifier and the lyric file. The second electronic device can acquire accompaniment audio and lyric file from a server, since the server in a long connection with the second electronic device often stores the accompaniment audio, the lyric file and the original singing audio of all the songs with broadcast copyrights, in this way, the second electronic device acquires the accompaniment audio and the lyric file from the server. Of course, the second electronic device can also directly search corresponding accompaniment audio and lyric file from the network, which is not defined in the embodiment of the present disclosure. Further, the accompaniment playing unit can be a player established by the second electronic device and configured to play the accompaniment audio. Specifically, the implementation process of establishing the player for playing audios can refer to the prior art, which is not defined in the embodiment of the present disclosure.

Substep (2): playing, by the second electronic device, the segment indicated by the singing range information in the accompaniment audio by utilizing the accompaniment playing unit, and displaying the lyric segment indicated by the singing range information in the lyric file.

In the present step, the second electronic device can utilize the accompaniment playing unit to firstly analyze the segment indicated by the singing range information in the accompaniment audio and then play the analyzed segment, where the beginning moment of the segment indicated by the singing range information in the accompaniment audio is matched with the start timestamp in the singing range information, and the ending moment of the segment indicated by the singing range information in the accompaniment audio is matched with the end timestamp in the singing range information. Exemplarily, suppose that the start timestamp indicates the 1000th millisecond, while the end timestamp indicates the 5000th millisecond, then the segment indicated by the singing range information in the accompaniment audio can be the accompaniment audio segment between the 1000th millisecond and the 5000th millisecond. Correspondingly, the accompaniment playing unit can be utilized to play the accompaniment audio segment between the 1000th millisecond and the 5000th millisecond.

Further, the starting moment corresponding to the first sentence of lyric of the segment indicated by the singing range information in the lyric file corresponds to the start timestamp in the singing range information, and the ending moment corresponding to the last sentence of lyric of the segment indicated by the singing range information in the lyric file corresponds to the end timestamp in the singing range information. Exemplarily, the segment indicated by the singing range information in the lyric file can be the lyric file between the 1000th millisecond and the 5000th millisecond. Correspondingly, the lyric file between the 1000th millisecond and the 5000th millisecond can be displayed.

In the embodiment of the present disclosure, the second electronic device can display synchronously the segment indicated by the singing range information in the lyric file, corresponding to the segment of the played accompaniment audio, and, in this way, through providing lyric reference to a non-live streaming user, the non-live streaming user finds it convenient to sing according to the displayed song, thereby improving the singing effect of the non-live streaming user, meanwhile, through playing and displaying part of the segments, the user can only sing part of the segments in the song, thereby improving singing experience of the user. Of course, in another optional embodiment of the present disclosure, the lyric file does not need to be acquired or displayed, in this way, the acquisition and display operations are omitted, thereby saving processing resources of the second electronic device to a certain extent, which is not defined in the embodiment of the present disclosure.

Further, in practical applications, the user may need to sing together with the original singing, to improve his own singing effect, therefore, the second electronic device can further perform the following substep, such that the user can sing according to the original singing.

Substep (3): acquiring, by the second electronic device, an original singing audio corresponding to the target song identifier and establishing an original singing playing unit if receiving the original singing opening instruction.

In the present substep, the original singing opening instruction can be sent to the second electronic device when the user plays the original sing audio of the target song, specifically, the original singing opening instruction can be sent by the user through triggering the original singing opening function of the second electronic device. Exemplarily, the second electronic device can display an original singing opening button, the user can click the original singing opening button to trigger the original singing opening function of the second electronic device. Correspondingly, after the second electronic device receives the original singing opening instruction and thinks that the user is singing, the second electronic device can perform original singing along with the original singing audio, therefore, the second electronic device can acquire the original singing audio corresponding to the target song identifier and establish an original singing playing unit.

Specifically, the second electronic device can acquire the original singing audio corresponding to the target song identifier from the server. Of course, the second electronic device can also search corresponding original singing audio from the network according to the target song identifier, which is not defined in the embodiment of the present disclosure. Further, the original singing playing unit can be a player established by the second electronic device and capable of playing the original singing audio. Specifically, the implementation process of establishing a player can refer to the related art, which is not defined in the embodiment of the present disclosure.

Substep (4): playing, by the second electronic device, the segment indicated by the singing range information in the original singing audio by utilizing the original playing unit.

In the present substep, the second electronic device can firstly analyze the segment indicated by the singing range information in the original singing audio by utilizing the original singing playing unit, and then play the analyzed segment, where the beginning moment of the segment indicated by the singing range information in the original singing audio is matched with the start timestamp in the singing range information, and the ending moment of the segment indicated by the singing range information in the original singing audio is matched with the end timestamp in the singing range information. Exemplarily, suppose that the start timestamp indicates the 1000th millisecond, while the end timestamp indicates the 5000th millisecond, then the segment indicated by the singing range information in the original singing audio can be the original singing audio segment between the 1000th millisecond and the 5000th millisecond. Correspondingly, the original singing playing unit can be utilized to play the original singing audio segment between the 1000th millisecond and the 5000th millisecond. Further, the non-live streaming user can also respectively adjust the output volumes of the original singing playing unit and the accompaniment playing unit, to control the volume of the original singing audio and the volume of the accompaniment audio. Exemplarily, FIG. 4-4 is a schematic diagram of a volume adjustment interface.

Step 404, playing, by the first electronic device, the accompaniment audio synchronously with the second electronic device according to the target song identifier when receiving the notification information.

Correspondingly, in the present step, the first electronic device can realize synchronous playing of the accompaniment audio through the following substeps (5) to (6).

Substep (5): acquiring the accompaniment audio of the target song according to the target song identifier.

Specifically, the first electronic device can acquire an accompaniment audio of a target song from the connected server, the accompaniment audio of the target song is just the accompaniment audio corresponding to the target song identifier. Of course, the first electronic device can also search corresponding accompaniment audio from the network according to the target song identifier, which is not defined in the embodiment of the present disclosure.

Substep (6): establishing an audio playing unit, and playing the segment indicated by the singing rang information in the accompaniment audio by utilizing the audio playing unit when receiving the notification information.

In the present substep, the audio playing unit can be a player established by first electronic device and capable of playing audios. Specifically, the implementation process of establishing a player can refer to the prior art, which is not defined in the embodiment of the present disclosure. Further, the manner in which the first electronic device utilizes the audio playing unit to play the segment indicated by the singing rang information in the accompaniment audio of the target song is similar to the manner in which the second electronic device plays the segment indicated by the singing range information in the accompaniment audio in the above step, and is not repeated redundantly in the embodiment of the present disclosure. In the embodiment of the present disclosure, the first electronic device plays the segment indicated by the singing range information when receiving the notification information, thereby ensuring that the first electronic device and the second electronic device play synchronously the same segment of accompaniment, and further improving playing consistency of the two equipment.

Further, the first electronic device can further acquire lyrics of a target song, and display the lyrics synchronously, thereby further improving user experience of the user, which is not defined in the embodiment of the present disclosure.

Further, since the network conditions of the second electronic device and the first electronic device may be different, the second electronic device or the first electronic device may be in a network jam, thereby further leading to non-synchronous accompaniment of the two, therefore, in the embodiment of the present disclosure, the first electronic device can further perform synchronous calibration on the accompaniment audio in the playing process through performing the following step C to step D.

Step C, receiving, by the first electronic device, the calibration information of the accompaniment audio provided by the second electronic device.

Here the accompaniment audio calibration information is sent by the second electronic device during the process of playing the accompaniment audio. Specifically, the second electronic device can send the accompaniment audio calibration information to the first electronic device in a preset period, where the preset period can be 200 milliseconds, that is, the second electronic device sends the accompaniment audio calibration information to the first electronic device every 200 milliseconds. Where the accompaniment audio calibration information can be the lyric sung by the user at the sending moment and the moment at which and the corresponding accompaniment audio is played, where the lyric corresponding to the singing audio collected by the second electronic device at the sending moment is just the lyric sung by the user at the sending moment, correspondingly, the accompaniment audio calibration information can include the lyric sung by the user at the sending moment and the moment at which the corresponding accompaniment audio is played. Here, the synchronization calibration operation can be realized on the basis of the broadcast information system (BIS) technology.

Step D, calibrating, by the first electronic device, the played accompaniment audio according to the accompaniment audio calibration information.

Here the specific operating manners for realizing calibration can be as follows: the first electronic device adjusts the playing schedule at which the accompaniment audio is played to the playing moment of the accompaniment audio if the singing audio matched with the lyrics included in the accompaniment audio calibration information is collected. Specifically, if the first electronic device collects the singing audio matched with the lyrics included in the accompaniment audio calibration information, the playing schedule at which the first electronic device plays the accompaniment audio does not reach the playing moment of the accompaniment audio in the accompaniment audio calibration information, that is, does not reach the playing moment actually corresponding to the lyric, then it can be deemed that the schedules at which the first electronic device and the second electronic device play the accompaniment audio are different, therefore, when the first electronic device adjusts the playing schedule at which the accompaniment audio is played to the playing moment of the accompaniment audio, the differences between the two can be eliminated to a certain extent, thereby further enabling the two to be more synchronous.

In the embodiment of the present disclosure, the first electronic device calibrates the accompaniment audio at a preset period according to the accompaniment audio calibration information, thereby avoiding the problem of desynchrony caused by network jam, and further improving synchronization degree.

Step 405, collecting, by the second electronic device, a singing audio and sending the singing audio.

Specifically, the present step can refer to the above step 203, which is not repeated redundantly in the embodiment of the present disclosure.

Step 406, acquiring, by the first electronic device, the singing audio sent by the second electronic device, taking the played accompaniment audio and the singing audio as a live stream, and sending the live stream to a server.

In the present step, the first electronic device can send the live stream to the server through a long connection, and the server can send the live stream to the third electronic device according to the equipment identifier of the third electronic device in the studio in which the first electronic device is participating. The equipment identifier of the third electronic device can be the identifier capable of uniquely identifying the third electronic device. Exemplarily, the equipment identifier of the third electronic device can be an IP address of the third electronic device, or the equipment number of the third electronic device, which is not defined in the embodiment of the present disclosure.

Further, in order that the third electronic device receives the live stream conveniently, and the user of the third electronic device can watch corresponding lyrics during playing, in the embodiment of the present disclosure, the first electronic device can perform the following step E before sending the live stream to the server.

Step E, inserting lyric timestamps into the live stream according to the playing moment corresponding to each data segment in the live stream.

In the present step, the playing moment corresponding to the data segment can be the timestamp information corresponding to the data segment. Further, the live stream is often composed of multiple audio data segments, the first electronic device can perform one inserting operation every preset number of audio data segments, and the specially inserted lyric timestamps can indicate the playing moment corresponding to the audio data segment of the inserting position. Here the operation of inserting lyric timestamps can be realized according to an audio stream information system (ASIS) technology. In this way, since the lyric timestamps can reflect the lyric schedule information, in the subsequent step, the third electronic device can specify the position of lyrics in synchrony with the played audio, that is, the lyric schedule, such that the third electronic device listening to the song can display lyrics synchronously, thereby improving the listening effect of the user of the third electronic device.

Step 407, acquiring, by the third electronic device, target song information provided by the second electronic device, where the target song information at least includes a target song identifier.

Specifically, the implementation manner of the present step can refer to the above step 301, which is not repeated redundantly in the embodiment of the present disclosure.

Step 408, acquiring, by the third electronic device, a lyric file of a target song according to the target song information.

In the present step, the target song information can also include singing range information, correspondingly, the third electronic device can first determine a lyric file matched with the target song identifier, specifically, the third electronic device can determine a lyric file matched with the target song identifier from the server. Of course, the third electronic device can also directly search a matching lyric file from the network, which is not defined in the embodiment of the present disclosure. Further, the third electronic device can acquire a segment indicated by the singing range information in the matching lyric file, to obtain a lyric file of the target song. In this way, the third electronic device can reduce the acquired data amount through only acquiring the lyric file in the singing range information. Wherein, the acquisition of a lyric file in the singing range information by the third electronic device can refer to the above steps, which will not be repeated redundantly herein.

Step 409, receiving, by the third electronic device, the live stream sent by a server, where the live stream includes a lyric timestamp.

Specifically, the implementation manner of the present step can refer to the above step 303, which is not repeated redundantly in the embodiment of the present disclosure.

Step 410, analyzing, by the third electronic device, the live stream, and displaying the corresponding lyric in the lyric file of the target song according to the lyric timestamp in the live stream.

Figure 5:
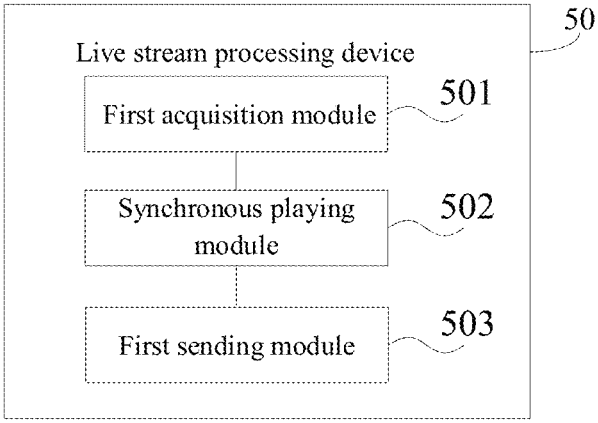
FIG. 5 is a block diagram of a live stream processing apparatus provided in an embodiment of the present disclosure.

Since the audio data segment in the live stream is data of the audio type, and the lyric timestamp is the data of the non-audio type, therefore, in an analyzing process, for the data of the audio type, the third electronic device can play by utilizing a playing unit, while for the data of the non-audio type, that is, the lyric timestamp, the lyric timestamp can be transmitted to a display processing module of the third electronic device, and the display processing module can display the lyric corresponding to the lyric timestamp, to realize synchronous display. Exemplarily, FIG. 4-5 is a schematic diagram of an interface of the third electronic device, it can be seen that, the interface is displayed with synchronized lyrics.

Figure 6:
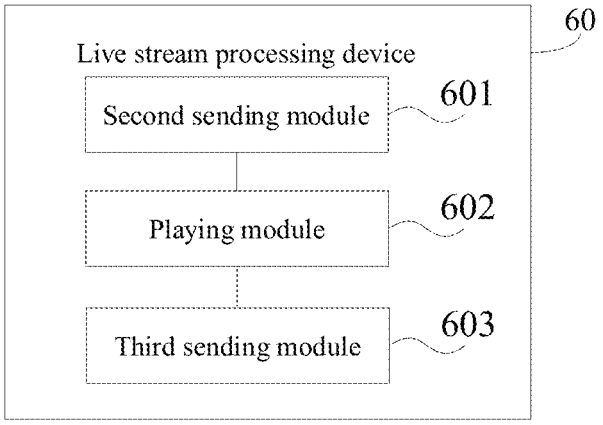
FIG. 6 is a block diagram of another live stream processing apparatus provided in an embodiment of the present disclosure.

It should be noted that, the first electronic device, the second electronic device and the third electronic device in the embodiment of the present disclosure can be the same electronic device. Exemplarily, in the scenarios in which the second electronic device and the third electronic device are taken as live streaming equipment, the second electronic device and the third electronic device can perform the operation performed by the first electronic device. In the scenarios in which the first electronic device is used as singing equipment in the studio, the first electronic device can perform the operation performed by the second electronic device. Further, in the scenarios in which the first electronic device is used as equipment to listen to the singing in the studio, the first electronic device can perform the operation performed by the third electronic device Further, FIG. 4-6 is a schematic diagram of a singing process, where the song request of a singer refers that the user chooses a target song according to the second electronic apparatus, the singer downloading the original singing, the accompaniment and the lyrics represents the second electronic device downloading the original singing audio, the accompaniment audio and the lyric file of the target song, the host in the block in the figure represents the first electronic device, and the audience in the block of the figure represents the third electronic device.

Further, for the objective of solving the problem of desynchrony of the accompaniment audio and the singing audio in the pushed live stream, in another optional embodiment of the present disclosure, the second electronic device can also play the accompaniment audio of the target song according to the target song identifier, collect the singing audio of the user and the played accompaniment audio as a live stream, and finally send the live stream to other equipment through a server, thereby omitting the accompaniment audio played by the first electronic device and the operation of collecting the live stream through the first electronic device, moreover, since the user of the second electronic device often sings corresponding to the accompaniment audio, the second electronic device collects live stream by itself, such that the songs listened to by other equipment according to the live stream in the subsequent steps are synchronous.

In summary, as to the live stream processing method provided in an embodiment of the present disclosure, the second electronic device provides target song information to the first electronic device, the target song information at least includes a target song identifier, and the first electronic device will acquire the target song information sent by the second electronic device through a server. Afterwards, the second electronic device will play the accompaniment audio of the target song according to the target song identifier, send notification information at the beginning of the playing of the accompaniment audio, collect the singing audio, and send the singing audio. Afterwards, the first electronic device will play the accompaniment audio of the target song synchronously with the second electronic device according to the target song identifier when the notification information is received, and acquire the singing audio sent by the second electronic device. Finally, the first electronic device will take the played accompaniment audio and the singing audio as a live stream and send the live stream to a server. The server will send the live stream to the third electronic device, and finally the third electronic device will analyze the live stream, and synchronously display the lyric file of the target song. Since the user of the second electronic device often sings corresponding to the accompaniment audio, in the embodiment of the present disclosure, the first electronic device will play synchronously the accompaniment audio when the second electronic device begins to play the accompaniment audio. In this way, the accompaniment audio and the singing voice in the live stream pushed in the subsequent steps can be synchronized to a certain extent, thereby improving the singing effect.

FIG. 5 is a block diagram of a live stream processing apparatus provided in an embodiment of the present disclosure, as shown in FIG. 5, the apparatus 50 can be applicable to the first electronic device, and the apparatus can include:

a first acquisition module 501, configured to acquire target song information provided by the second electronic device, where the target song information at least includes a target song identifier;

a synchronous playing module 502, configured to play an accompaniment audio of the target song synchronously with the second electronic device according to the target song identifier when notification information is received, and acquire a singing audio sent by the second electronic device, where the notification information is used for indicating that the second electronic device begins to play the accompaniment audio; and a first sending module 503, configured to take the played accompaniment audio and the singing audio as a live stream, and send the live stream to a server.

The apparatus provided in an embodiment of the present disclosure can acquire the target song information provided by the second electronic device, where the target song information at least includes a target song identifier. Afterwards, the apparatus can play the accompaniment audio synchronously with the second electronic device according to the target song identifier when the notification information is received, that is, when the second electronic device plays the accompaniment audio of the target song, and acquire the singing audio sent by the second electronic device through a server. Finally, the apparatus takes the played accompaniment audio and the singing audio as a live stream and sends the live stream to a server. Since the user of the second electronic device often sings corresponding to the accompaniment audio, in the embodiment of the present disclosure, the first electronic device will play synchronously the accompaniment audio when the second electronic device begins to play the accompaniment audio. In this way, the accompaniment audio and the singing audio in the live stream obtained according to collected accompaniment audio played by the first electronic device and acquired singing audio in the subsequent steps can be synchronized to a certain extent, thereby improving the singing effect.

In one possible implementation, the apparatus 50 further includes:

a first receiving module, configured to receive accompaniment audio calibration information provided by the second electronic device, where the accompaniment audio calibration information is provided by the second electronic device in the process of playing the accompaniment audio; and a calibration module, configured to calibrate the played accompaniment audio according to the accompaniment audio calibration information.

In one possible implementation, the accompaniment audio calibration information includes lyrics sung by the user at the sending moment and playing moment of the corresponding accompaniment audio.

the calibration module is configured to: adjust the playing schedule at which the accompaniment audio is played to the playing moment of the accompaniment audio if a singing audio matched with the lyrics included in the accompaniment audio calibration information is collected.

In one possible implementation, the target song information further includes singing range information;

the synchronous playing module 502 is configured to:

acquire an accompaniment audio of the target song according to the target song identifier; and establish an audio playing unit, and play a segment indicated by the singing range information in the accompaniment audio by utilizing the audio playing unit when the notification information is received.

In one possible implementation, the apparatus 50 further includes:

an inserting module, configured to insert lyric timestamps into the live stream according to the playing moment corresponding to each data segment in the live stream.

As to the apparatus in the above embodiment, specific manners in which each module performs operations have been described in detail in the embodiment related to the method, and will not be described in detail herein.

FIG. 6 is a block diagram of another live stream processing apparatus provided in an embodiment of the present disclosure, as shown in FIG. 6, the apparatus 60 can be applicable to second electronic device, and the apparatus can include:

a second sending module 601, configured to provide target song information to first electronic device, where the target song information at least includes a target song identifier;

a playing module 602, configured to play the accompaniment audio of the target song according to the target song identifier, and send notification information at the beginning of the playing of the accompaniment audio; where the notification information is used for indicating that the second electronic device begins to play the accompaniment audio; and a third sending module 603, configured to collect the singing audio, and send the singing audio.

The apparatus provided in an embodiment of the present disclosure can provide target song information to the first electronic device, wherein the apparatus plays the accompaniment audio of the target song according to the target song identifier, and sends notification information at the beginning of the playing of the accompaniment audio, such that the first electronic device and the second electronic device can play the accompaniment audio synchronously, and finally, the apparatus can collect the singing audio of the user of the second electronic device and send the singing audio to the first electronic device through a server. Since the user of the second electronic device often sings corresponding to the accompaniment audio, therefore, in the embodiment of the present disclosure, the accompaniment audio and the singing audio in the live stream pushed by the first electronic device to other second electronic device in the subsequent process can be synchronized to a certain extent, thereby improving the singing effect.

In one possible implementation, the target song information can further include singing range information;

the apparatus 60 further includes:

a first display module, configured to display a singing range selection page if a singing range setting instruction is received; and a second acquisition module, configured to detect a selection operation on the singing range selection page, and acquire a start timestamp and an end timestamp according to the selection operation to obtain the singing range information.

Correspondingly, the second sending module 601 is configured to: provide the singing range information and the target song identifier to the first electronic device.

In one possible implementation, the playing module 602 is configured to:

acquire an accompaniment audio corresponding to the target song identifier and a lyric file, and establish an accompaniment playing unit; and play a segment indicated by the singing range information in the accompaniment audio by utilizing the accompaniment playing unit, and display the segment indicated by the singing range information in the lyric file.

As to the apparatus in the above embodiment, specific manners in which each module performs operations have been described in detail in the embodiment related to the method, and will not be described in detail herein.

Figure 7:
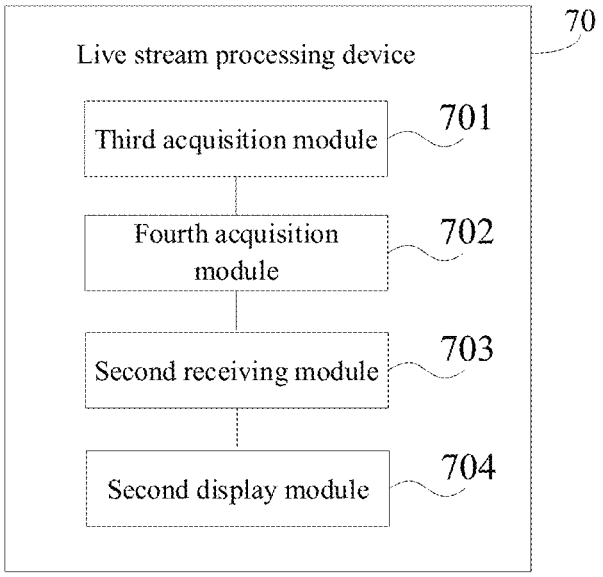
FIG. 7 is a block diagram of still another live stream processing apparatus provided in an embodiment of the present disclosure.

FIG. 7 is a block diagram of still another live stream processing apparatus provided in an embodiment of the present disclosure, as shown in FIG. 7, the apparatus 70 can be applicable to third electronic device, and the apparatus can include:

a third acquisition module 701, configured to acquire target song information provided by second electronic device, where the target song information at least includes a target song identifier;

a fourth acquisition module 702, configured to acquire a lyric file of the target song according to the target song information;

a second receiving module 703, configured to receive the live stream sent by a server, where the live stream includes lyric timestamps; and a second display module 704, configured to analyze the live stream, and display corresponding lyrics in the lyric file of the target song according to the lyric timestamps in the live stream.

The apparatus provided by the embodiment of the present disclosure will acquire target song information provided by the second electronic device, where the target song information can at least include a target lyric identifier, acquire a lyric file of the target song according to the target song information, and then receive the live stream sent by a server. The live stream includes lyric timestamps, and the live stream is analyzed and the corresponding lyric in the lyric file of the target song is displayed according to the lyric timestamp in the live stream. Since the live stream is collected by the first electronic device when the first electronic device plays the accompaniment audio synchronously with the second electronic device, the accompaniment audio and the singing audio in the live stream are synchronous, correspondingly, the third electronic device can play audios with a higher synchronization degree through analyzing the live stream, meanwhile, the corresponding lyric in the lyric file of the target song is displayed according to the lyric timestamp in the live stream, then lyrics can be displayed synchronously while playing, thereby further improving the listening effect.

In one possible implementation, the target song information can further include singing range information; the fourth acquisition module 702 is configured to:

determine the lyric file matched with the target song identifier; and acquire a segment indicated by the singing range information in the matched lyric file, to obtain a lyric file of the target song.

As to the apparatus in the above embodiment, specific manners in which each module performs operations have been described in detail in the embodiment related to the method, and will not be described in detail herein.

Figure 8:
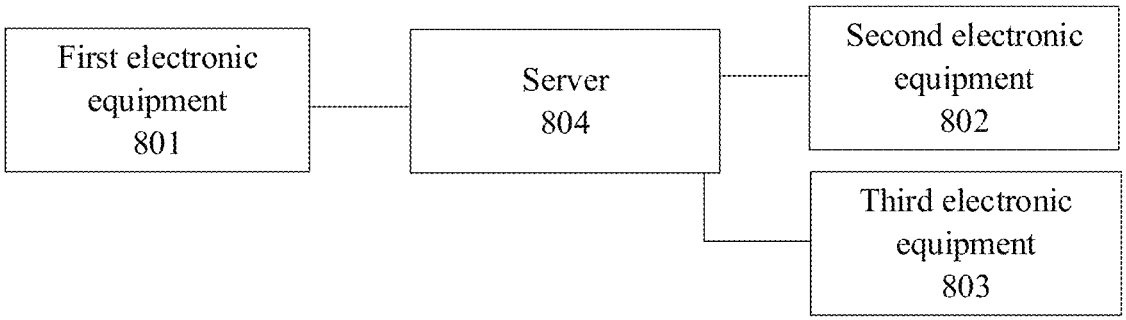
FIG. 8 is a block diagram of a live stream processing system provided in an embodiment of the present disclosure.

FIG. 8 is a block diagram of a live stream processing system provided in an embodiment of the present disclosure, as shown in FIG. 8, the system 80 can include: first electronic device 801, second electronic device 802, third electronic device 803 and a server 804; where the second electronic device 802 is configured to provide target song information to the first electronic device 801, where the target song information at least includes a target song identifier;

the first electronic device 801 is configured to acquire the target song information provided by the second electronic device 802;

the second electronic device 802 is configured to play the accompaniment audio of the target song according to the target song identifier, and send the notification information at the beginning of the playing of the accompaniment audio;

the second electronic device 802 is configured to collect the singing audio, and send the singing audio;

the first electronic device 801 is configured to play an accompaniment audio of the target song synchronously with the second electronic device 802 according to the target song identifier when notification information is received, and acquire a singing audio sent by the second electronic device 802;

the first electronic device 801 is configured to take the played accompaniment audio and the singing audio as a live stream, and send the live stream to the server 804;

the third electronic device 803 is configured to acquire target song information provided by the second electronic device 802, and acquire a lyric file of the target song according to the target song information, where the target song information at least includes the target song identifier;

the third electronic device 803 is configured to receive the live stream sent by a server 804, where the live stream includes a lyric timestamp; and the third electronic device 803 is configured to analyze the live stream, and display corresponding lyrics in the lyric file of the target song according to the lyric timestamp in the live stream.

As to the live stream processing system provided in an embodiment of the present disclosure, the second electronic device provides target song information to the first electronic device, the target song information at least includes a target song identifier, and the first electronic device will acquire the target song information sent by the second electronic device through a server. Afterwards, the second electronic device will play the accompaniment audio of the target song according to the target song identifier, send notification information at the beginning of the playing of the accompaniment audio, collect the singing audio, and send the singing audio. Afterwards, the first electronic device will play the accompaniment audio of the target song synchronously with the second electronic device according to the target song identifier when the notification information is received, and acquire the singing audio sent by the second electronic device. Finally, the first electronic device will take the played accompaniment audio and the singing audio as a live stream and send the live stream to a server. The server will send the live stream to the third electronic device, and finally the third electronic device will analyze the live stream, and synchronously display the lyric file of the target song. Since the user of the second electronic device often sings corresponding to the accompaniment audio, in the embodiment of the present disclosure, the first electronic device will play synchronously the accompaniment audio when the second electronic device begins to play the accompaniment audio. In this way, the accompaniment audio and the singing voice in the live stream pushed in the subsequent steps can be synchronized to a certain extent, thereby improving the singing effect.

An embodiment of the present disclosure further provides a storage medium, when the instruction in the storage medium is executed by the processor of the electronic device, the electronic device can perform the steps in the live stream processing method in any of the above embodiments.

An embodiment of the present disclosure further provides an application, when the application is executed by the processor, the steps in the live stream processing method in any of the above embodiments are realized.

Figure 9:
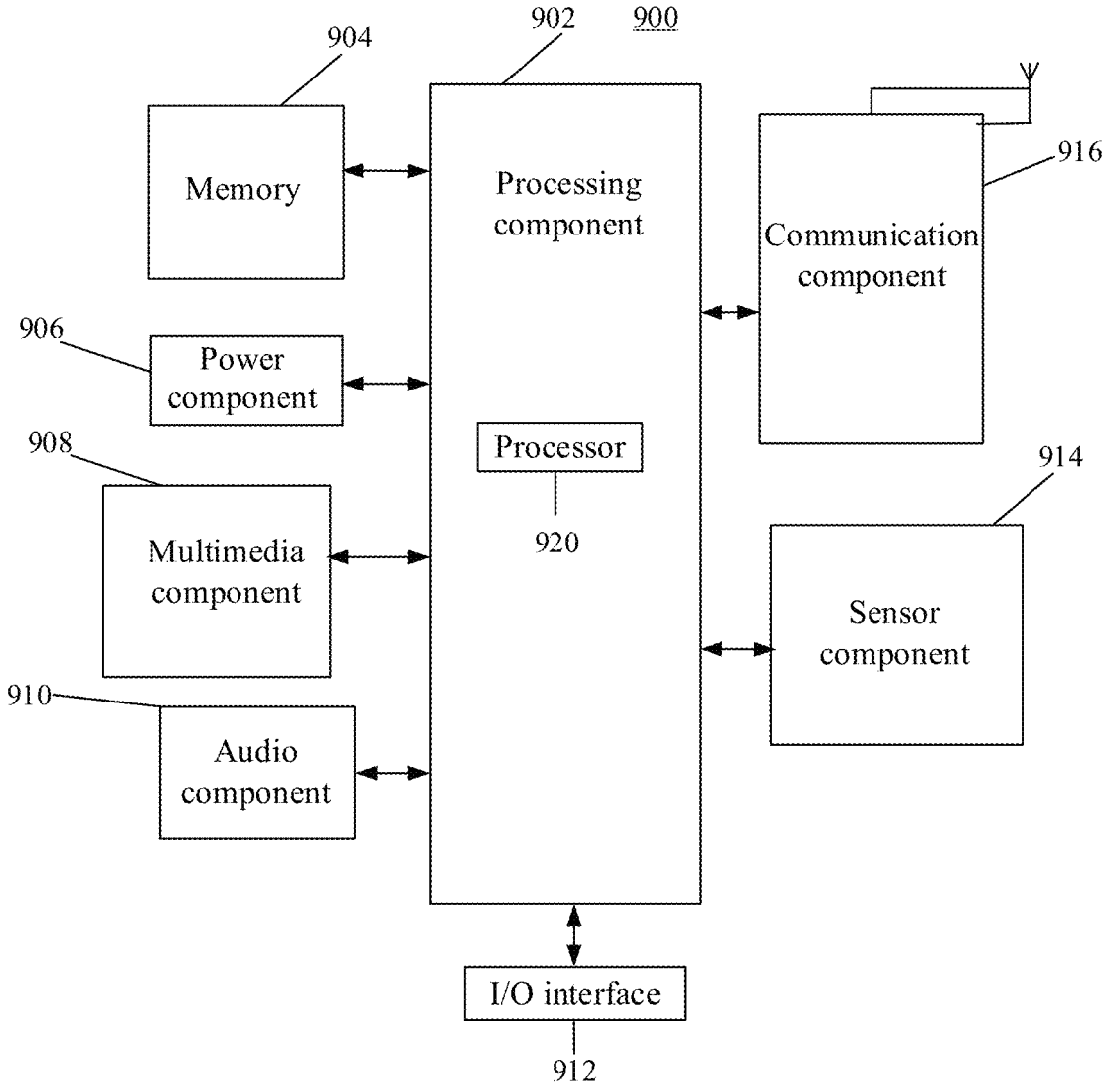
FIG. 9 is a block diagram of an electronic device shown according to one exemplary embodiment.

FIG. 9 is a block diagram of electronic device 900 shown in an examplary embodiment. For example, the electronic device 900 can be a mobile phone, a computer, a digital broadcasting terminal, a message transceiver, a game console, a tablet device, a medical device, a fitness device, a personal digital assistant, etc. Please refer to FIG. 9, the electronic device 900 can include one or more of the following components: a processing component 902, a memory 904, a power component 906, a multimedia component 908, an audio component 10, an input/output (I/O) interface 912, a sensor component 914 and a communication component 916.

The processing component 902 generally controls the overall operation of the electronic device 900, such as operations related to display, telephone call, data communication, camera operation and record operation. The processing component 902 can include one or more processors 920 to execute instructions, to finish all or part of the steps of the above method. In addition, the processing component 902 can include one or more modules, to facilitate interaction between the processing component 902 and other components. For example, the processing component 902 can include a multimedia module, to facilitate interaction between the multimedia component 908 and the processing component 902.

The memory 904 is configured to store various types of data to support operations on the equipment 900. The examples of these data include instructions of any application or method operable on the electronic device 900, contact data, telephone directory data, message, pictures and videos. The memory 904 can be realized through any type of volatile or nonvolatile storage device or a combination thereof, such as a static random access memory (SRAM), an electrically erasable programmable read-only memory (EEPROM), an electrically programmable read-only memory (EPROM), a programmable read-only memory (PROM), a read-only memory (ROM), a magnetic memory, a flash memory, a magnetic disk or an optical disk.

The power component 906 provides power to various components of the electronic device 900. The power component 906 can include a power management system, one or more power supplies, and other components related to generation, management and power distribution of the electronic device 900.

A multimedia component 908 includes a screen which provides an output interface between the electronic device 900 and the user. In some embodiments, the screen can include a liquid crystal display (LCD) and a touch panel (TP). If the screen includes a touch panel, the screen can be realized as a touch screen, to receive input signals of the user. The touch panel includes one or more touch sensors to sense touching, sliding and gestures on the touch panel. The touch sensor can not only touch the boundary of the touching or sliding action, but also can detect the continuous time and pressure related to the touching or sliding operation. In some embodiments, the multimedia component 908 includes a front camera and/or a rear camera. When the equipment 900 is in an operating mode, for example, in an image capturing mode or a video mode, the front camera and/or the rear camera can receive external multimedia data. Each front camera and rear camera can be a fixed optical lens system or can have focal length and an optical zoom capability.

The audio component 910 is configured to output and/or input audio signals. For example, the audio component 910 includes a microphone (MIC), when the electronic device 900 is in an operating mode, for example a call mode, a record mode and a speech recognition mode, the microphone is configured to receive external audio signals. The received audio signals can be further stored in the memory 904 and sent via the communication component 916. In some embodiments, the audio component 910 further includes a loudspeaker configured to output audio signals.

The I/O interface 912 can provide an interface to the processing component 902 and the peripheral interface module, and the above peripheral interface module can be a keyboard, a click wheel, a button, etc. These buttons can include but are not limited to: a home button, a volume button, a start button and a lock button.

The sensor component 914 includes one or more sensors, configured to evaluate states of each aspect of the electronic device 900. For example, the sensor component 914 can detect the opening/closing state of the device 900 and relative positioning of components, for example, when the component is a display and a keypad of the electronic device 900, the sensor component 914 can also detect position change of the electronic device 900 or one component of the electronic device 900, the existence or nonexistence of the contact between the user and the electronic device 900, the orientation or acceleration/deceleration of the electronic device 900, and temperature change of the electronic device 900. The sensor component 914 can include a proximity sensor which is configured to detect existence of nearby objects when no physical contact exists. The sensor component 914 can further include an optical sensor, such as a CMOS or CCD image sensor, configured to be used in imaging applications. In some embodiments, the sensor component 914 can further include an acceleration sensor, a gyroscope sensor, a magnetic sensor, a pressure sensor or a temperature sensor.

The communication component 916 is configured to facilitate wired or wireless communication between the electronic device 900 and other apparatuss. The electronic device 900 can be accessed to a wireless network according to a communication standard, such as WiFi, network of a service provider (such as 2G, 3G, 4G or 5G) or a combination thereof. In one exemplary embodiment, the communication component 916 receives broadcast signals or broadcast related information from an external broadcast management system via a broadcasting channel. In one exemplary embodiment, the communication component 916 further includes a near-field communication (NFC) module, to facilitate short range communication.

In an exemplary embodiment, the electronic device 900 can be implemented through one or more application specific integrated circuits (ASICs), digital signal processors (DSPs), digital signal processing devices (DSPDs), programmable logic devices (PLDs), field programmable gate arrays (FPGAs), controllers, microcontrollers, microprocessors or other electronic elements, to perform the steps in the above live stream processing method.

In an exemplary embodiment, a non-temporary computer readable storage medium including instructions is further provided, for example, a memory 904 including instructions, and the above instructions can be executed by the processor 920 of the electronic device 900 to complete the above method. For example, the non-temporary computer readable storage medium can be an ROM, a random access memory (RAM), a CD-ROM, a magnetic tape, a floppy disk and an optical data storage apparatus, etc.

Figure 10:
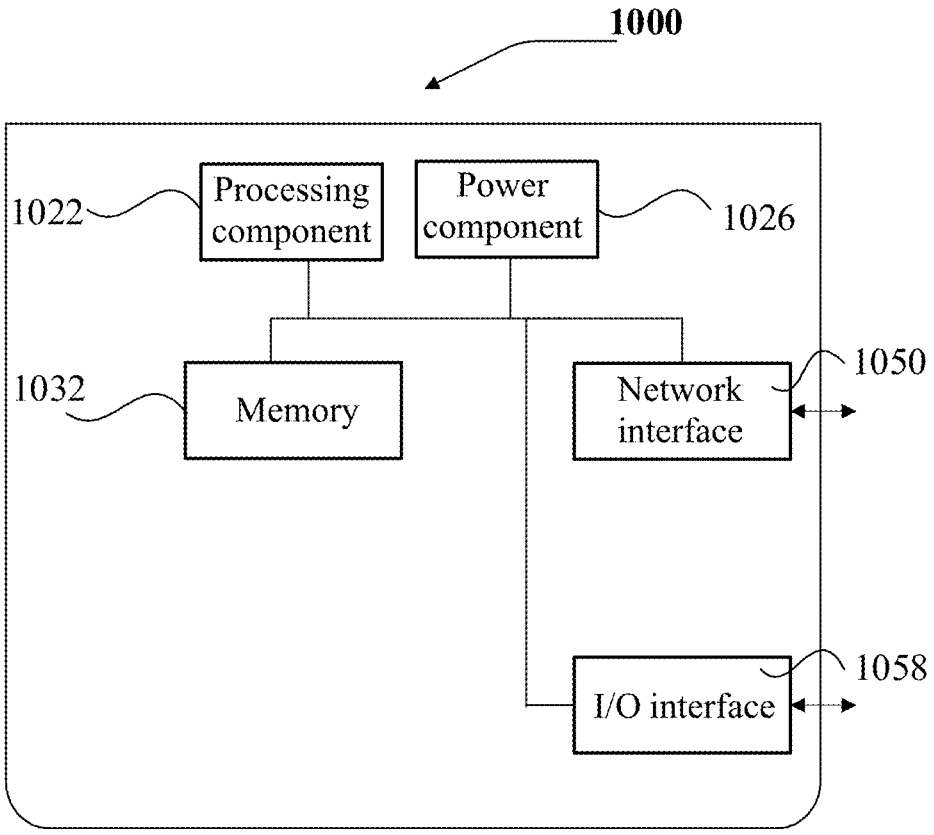
FIG. 10 is a block diagram of another electronic device shown according to one exemplary embodiment.

FIG. 10 is a block diagram of another electronic device 1000 shown in an exemplary embodiment. Please refer to FIG. 10, the electronic device 1000 includes a processing component 1022 which further includes one or more processors, and memory resources represented by a memory 1032, where the memory resources are configured to store instructions executable by the processing component 1022, for example, applications. The applications stored in the memory 1032 can include one or more modules, with each of the modules corresponds to one group of instructions. In addition, the processing component 1022 is configured to execute instructions, to perform the steps in the above live stream processing method.

The electronic device 1000 can further include: a power component 1026 configured to perform power management on the electronic device 1000, one wired or wireless network interface 1050 configured to connect the electronic device 1000 to the network, and one input/output (I/O) interface 1058. The electronic device 1000 can operate the operating system stored in the memory 1032, for example, Windows Server™, Mac OS X™, Unix™, Linux™, FreeBSD™ or the like.

Those skilled in the art will easily conceive of other implementations of the present disclosure after considering the description and practicing the invention disclosed herein. The present disclosure intends to cover any variation, application, or adaptive change of the present disclosure, and these variations, applications, or adaptive changes comply with the general principles of the present disclosure and contain common knowledge or customary technical means in the technical field not disclosed in the present disclosure. The description and embodiments are considered exemplary only, and the true scope and spirit of the present disclosure are indicated by the claims.

It should be understood that, the present disclosure is not limited to the precise structures described above and shown in the accompanying drawings, and various modifications and variations can be made without departing from the scope of the present disclosure. The scope of the present disclosure is merely limited by the appended claims.

What is claimed is:

1. A live stream processing method applied to a first electronic device, comprising:

acquiring target song information provided by a second electronic device, wherein the target song information at least comprises a target song identifier;

playing an accompaniment audio of the target song synchronously with the second electronic device according to the target song identifier when receiving notification information, and acquiring a singing audio sent by the second electronic device; wherein the notification information is used for indicating that the second electronic device begins to play the accompaniment audio; and taking the played accompaniment audio and the singing audio as a live stream, and sending the live stream to a third electronic device via a server;

wherein after playing an accompaniment audio of the target song synchronously with the second electronic device, the method further comprises:

receiving accompaniment audio calibration information provided by the second electronic device, wherein the accompaniment audio calibration information is provided by the second electronic device during a process of playing the accompaniment audio; and calibrating the played accompaniment audio according to the accompaniment audio calibration information.

2. The method of claim 1, wherein the accompaniment audio calibration information comprises lyrics sung by the user at a sending moment and playing moment of the corresponding accompaniment audio;

wherein calibrating the played accompaniment audio according to the accompaniment audio calibration information comprises:

adjusting a playing schedule at which the accompaniment audio is played to the playing moment of the accompaniment audio, if a singing audio matched with the lyrics comprised in the accompaniment audio calibration information is collected.

3. The method of claim 1, wherein the target song information further comprises singing range information;

wherein playing an accompaniment audio of the target song synchronously with the second electronic device according to the target song identifier when receiving notification information comprises:

acquiring the accompaniment audio of the target song according to the target song identifier; and establishing an audio playing unit, and playing a segment indicated by the singing range information in the accompaniment audio by utilizing the audio playing unit when receiving the notification information.

4. The method of claim 1, wherein before sending the live stream to a server, the method further comprises:

inserting lyric timestamps into the live stream according to the playing moment corresponding to each data segment in the live stream.

5. An electronic device, comprising:

a processer; and a memory configured to store executable instructions of the processor;

wherein the processor is configured to execute the instructions, to implement the operations performed by the live stream processing method of claim 1.

6. The electronic device of claim 5, wherein the accompaniment audio calibration information comprises lyrics sung by the user at a sending moment and playing moment of the corresponding accompaniment audio;

wherein calibrating the played accompaniment audio according to the accompaniment audio calibration information comprises:

adjusting a playing schedule at which the accompaniment audio is played to the playing moment of the accompaniment audio, if a singing audio matched with the lyrics comprised in the accompaniment audio calibration information is collected.

7. A non-transitory computer readable storage medium, wherein when the instructions in the non-transitory computer readable storage medium are executed by the processor of the electronic device, the electronic device can implement the operations performed by the live stream processing method of claim 1.

8. A live stream processing method applied to a second electronic device, comprising:

providing target song information to a first electronic device, wherein the target song information at least comprises a target song identifier;

playing an accompaniment audio of the target song according to the target song identifier, and sending notification information to the first electronic device at a beginning of the playing of the accompaniment audio; wherein the notification information is used for indicating that the second electronic device begins to play the accompaniment audio; and collecting the singing audio, and sending the singing audio via a server to the first electronic device, so that the first electronic device takes a played accompaniment audio of the target song of the first electronic device which starts synchronously with the second electronic device according to the target song identifier when receiving the notification information and the singing audio as a live stream, and sends the live stream to a third electronic device via the server;

wherein the method further comprises:

providing accompaniment audio calibration information during a process of playing the accompaniment audio; and sending the accompaniment audio calibration information, so that the first electronic device calibrates the played accompaniment audio according to the accompaniment audio calibration information.

9. The method of claim 8, wherein the target song information further comprises singing range information;

wherein before providing target song information to first electronic device, the method further comprises:

displaying a singing range selection page if receiving a singing range setting instruction; and detecting a selection operation on the singing range selection page, and acquiring a start timestamp and an end timestamp according to the selection operation to obtain the singing range information;

wherein providing target song information to first electronic device comprises:

providing the singing range information and the target song identifier to the first electronic device.

10. The method of claim 9, wherein playing the accompaniment audio of the target song according to the target song identifier comprises:

acquiring an accompaniment audio corresponding to the target song identifier and a lyric file, and establishing an accompaniment playing unit; and playing a segment indicated by the singing range information in the accompaniment audio by utilizing the accompaniment playing unit, and displaying the segment indicated by the singing range information in the lyric file.

11. An electronic device, comprising:

a processer; and a memory configured to store executable instructions of the processor;

wherein the processor is configured to execute the instructions, to implement the operations performed by the live stream processing method of claim 8.

12. The electronic device of claim 11, wherein the target song information further comprises singing range information;

wherein before providing target song information to first electronic device, the method further comprises:

displaying a singing range selection page if receiving a singing range setting instruction; and detecting a selection operation on the singing range selection page, and acquiring a start timestamp and an end timestamp according to the selection operation to obtain the singing range information;

wherein providing target song information to first electronic device comprises:

providing the singing range information and the target song identifier to the first electronic device.

13. A non-transitory computer readable storage medium, wherein when the instructions in the non-transitory computer readable storage medium are executed by the processor of the electronic device, the electronic device can implement the operations performed by the live stream processing method of claim 8.

14. A live stream processing method applied to a third electronic device, comprising:

acquiring target song information provided by a second electronic device, wherein the target song information at least comprises the target song identifier;

acquiring a lyric file of the target song according to the target song information;

receiving a live stream sent by a first electronic device via a server, wherein the live stream comprises lyric timestamps, a played accompaniment audio of the target song of the first electronic device and a singing audio which is provided by the second electronic device and acquired by the first electronic device; wherein the played accompaniment audio of the target song of the first electronic device starts synchronously with the second electronic device according to the target song identifier when receiving notification information provided by the second electronic device indicating that the second electronic device begins to play an accompaniment audio at the second electronic device; and wherein the played accompaniment audio of the target song of the first electronic device is calibrated by the first electronic device according to accompaniment audio calibration information provided by the second electronic device during a process of playing the accompaniment audio at the second electronic device; and analyzing the live stream, and displaying corresponding lyrics in the lyric file of the target song according to the lyric timestamp in the live stream.

15. The method of claim 14, wherein the target song information further comprises singing range information, wherein acquiring a lyric file of the target song according to the target song information comprises:

determining a lyric file matched with the target song identifier; and acquiring a segment indicated by the singing range information in the matched lyric file, to obtain a lyric file of the target song.

16. An electronic device, comprising:

a processer; and a memory configured to store executable instructions of the processor;

wherein the processor is configured to execute the instructions, to implement the operations performed by the live stream processing method of claim 14.

17. The electronic device of claim 16, wherein the target song information further comprises singing range information, wherein acquiring a lyric file of the target song according to the target song information comprises:

determining a lyric file matched with the target song identifier; and acquiring a segment indicated by the singing range information in the matched lyric file, to obtain a lyric file of the target song.

18. A non-transitory computer readable storage medium, wherein when the instructions in the non-transitory computer readable storage medium are executed by the processor of the electronic device, the electronic device can implement the operations performed by the live stream processing method of claim 14.

* * * * *